US009421792B2

(12) United States Patent
Aihara et al.

(10) Patent No.: US 9,421,792 B2
(45) Date of Patent: Aug. 23, 2016

(54) PRINTING APPARATUS

(71) Applicants: Yuichi Aihara, Yamanashi-ken (JP); Yasutake Ohshiro, Yamanashi-ken (JP)

(72) Inventors: Yuichi Aihara, Yamanashi-ken (JP); Yasutake Ohshiro, Yamanashi-ken (JP)

(73) Assignee: NISCA CORPORATION, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 14/679,479

(22) Filed: Apr. 6, 2015

(65) Prior Publication Data

US 2015/0283824 A1 Oct. 8, 2015

(30) Foreign Application Priority Data

Apr. 8, 2014 (JP) ..... 2014-079572

(51) Int. Cl.

| | |
|---|---|
| ***B41J 33/16*** | (2006.01) |
| ***B41J 33/34*** | (2006.01) |
| ***B65H 23/18*** | (2006.01) |
| ***B41J 2/325*** | (2006.01) |
| ***B41J 2/355*** | (2006.01) |
| ***B41J 17/07*** | (2006.01) |

(52) U.S. Cl.
CPC *B41J 2/325* (2013.01); *B41J 2/355* (2013.01); *B41J 17/07* (2013.01); *B41J 33/16* (2013.01)

(58) Field of Classification Search
CPC ..... B41J 2/32; B41J 2/335; B41J 33/00; B41J 33/14; B41J 33/16; B41J 33/34; B41J 33/36; B41J 33/40; B41J 33/44; B41J 33/52; B41J 33/54; B41J 29/38; B41J 29/48; B65H 23/00; B65H 23/18
USPC ..... 400/223, 234, 618
See application file for complete search history.

(56) References Cited

U.S. PATENT DOCUMENTS

| | | | | |
|---|---|---|---|---|
| 3,669,382 | A * | 6/1972 | Struzina | G05D 3/14 242/333 |
| 5,751,331 | A * | 5/1998 | Higuchi | B41J 33/36 347/217 |
| 2008/0240830 | A1* | 10/2008 | McNestry | B41J 33/34 400/234 |
| 2009/0269119 | A1* | 10/2009 | Hatada | B41J 11/001 400/618 |
| 2014/0132698 | A1* | 5/2014 | Lakin | B41J 2/315 347/217 |

FOREIGN PATENT DOCUMENTS

| | | | | |
|---|---|---|---|---|
| JP | 62195747 | A * | 8/1987 | B65H 23/18 |
| JP | 07334895 | A * | 12/1995 | B65H 23/18 |
| JP | H08-002078 | A | 1/1996 | |

* cited by examiner

*Primary Examiner* — Nguyen Ha
(74) *Attorney, Agent, or Firm* — Manabu Kanesaka

(57) ABSTRACT

To provide a printing apparatus capable of preventing the image quality from deteriorating, the printing apparatus is provided with a ribbon 41 laid between spools 43, 44, DC motors Mr3, Mr1 for rotating these spools, driver for supplying driving power to the motors, encoders for detecting rotation amounts of the motors, and controller that controls the driver. A CPU drives the motor without the tension due to the ribbon 41 being applied, calculates the rotation velocity of the motor based on the rotation amount of the motor detected in the encoder, applies the calculated rotation velocity and the supply current in driving the motor to the relationship between the rotation velocity and the supply current in a reference motor, and calculates the supply current for providing the same rotation velocity as the rotation velocity in driving the reference motor with the supply current of the time the motor is driven.

10 Claims, 18 Drawing Sheets

PRINTING APPARATUS

TECHNICAL FIELD

The present invention relates to a printing apparatus, and more particularly, to a printing apparatus provided with a thermal head.

BACKGROUND ART

Conventionally, such a printing apparatus has been known widely that forms an image on a printing medium using a thermal head. This type of printing apparatus uses an indirect printing scheme for forming an image (mirror image) on a transfer film using an ink ribbon, and next transferring the image formed on the transfer film to a printing medium, or a direct printing scheme for forming an image directly on a printing medium using an ink ribbon.

Generally, in such a printing apparatus are inserted an ink ribbon cassette storing an ink ribbon (film-shaped medium) laid between a supply spool and a wind-up spool, and similarly, a transfer film cassette storing a transfer film (film-shaped medium) laid between a supply spool and a wind-up spool.

In this type of printing apparatus, such a technique is disclosed that a certain tension is added to the ink ribbon corresponding to a variation in the diameter (roll diameter) of the ink ribbon wound around the spool (for example, see Patent Document 1).

PRIOR ART DOCUMENT

Patent Document

[Patent Document 1] Japanese Patent Application Publication No. H08-2078 (see FIG. 1 and paragraph [0090])

DISCLOSURE OF INVENTION

Problems to be Solved by the Invention

In addition, in order to ensure image quality, as in the invention of Patent Document 1, it is necessary to make the tension relative to the film-shaped medium a certain corresponding to a variation in the roll diameter, but since torque of a DC motor itself varies with the environmental temperature, age deterioration and the like of the DC motor, it is difficult to always provide the film-shaped medium with a certain tension even in controlling the DC motor corresponding to the roll diameter.

As the solution, it is conceivable to measure a rotation velocity of the DC motor with respect to a predetermined current at constant frequencies, calculate a difference between the velocity and a reference rotation velocity, and correct a supply current (duty) to the DC motor. However, in a mechanism in which a plurality of DC motors transport the film-shaped medium as disclosed in Patent Document 1, in measuring the rotation velocity of the DC motor, when the film-shaped medium is in a state in which the tension is applied to the film-shaped medium, the effect due to the tension of the film-shaped medium is exerted, it is thereby not possible to obtain a correct measurement value of the rotation velocity of the DC motor, and it is not possible to properly correct the supply current to the DC motor. In other words, although the correction due to the variation of the roll diameter has conventionally been made, it is not possible to obtain the correct tension of the film-shaped medium unless the DC motor as a base is corrected properly, and there is a problem that the image quality deteriorates.

In view of the above-mentioned matters, it is an object of the present invention to provide a printing apparatus capable of preventing the image quality from deteriorating, by correcting a supply current to a DC motor properly.

To attain the above-mentioned object, in the present invention, a printing apparatus provided with a printing section to print text or an image on a printing target medium from a film-shaped medium is characterized by being provided with a supply spool that feeds out a film-shaped medium to the printing section side in printing processing, a wind-up spool that winds up the film-shaped medium from the printing section side in the printing processing, a DC motor that rotates at least one of the supply spool and the wind-up spool, a motor driver that supplies a drive current to the DC motor, a rotation amount detector that detects a rotation amount of the DC motor, and a controller that controls the motor driver, where the controller calculates a drive current to be supplied to the DC motor for providing DC motor with the same rotation velocity as a rotation velocity of a reference DC motor driven with the same drive current in driving the DC motor without the tension due to the film-shaped medium being applied, and controls the motor driver to supply the calculated drive current.

In the invention, since the DC motor generates a difference in the rotation velocity according to the rotation direction, in driving the DC motor without the tension due to the film-shape medium being applied, it is preferable that the controller drives in the same direction as the rotation direction of the DC motor for transporting the film-shaped medium from the supply spool side to the wind-up spool side. Further, the controller may drive the DC motor without the tension due to the film-shaped medium being applied, calculate a rotation velocity of the DC motor based on the rotation amount of the DC motor detected in the rotation amount detector, refer to the relationship between the rotation velocity and the supply current in the reference motor, calculate a supply current of the DC motor for providing the same rotation velocity as a rotation velocity of the time the reference motor is driven with the supply current at the calculated rotation velocity, and control the motor driver to supply the calculated supply current.

Further, before the printing processing with the thermal head, the controller may drive the DC motor with the film-shaped medium sagged to calculate the rotation velocity of the DC motor.

The apparatus is further provided with a mark detector that detects an empty mark indicative of a use limit of the film-shaped medium attached to an end portion of the film-shaped medium, and after the mark detector detects the empty mark, the control may drive the DC motor with the film-shaped medium sagged to calculate the rotation velocity of the DC motor. At this point, the apparatus is further provided with a nonvolatile memory, and the controller may store the calculated value of supply current in the nonvolatile memory, reads the value of supply current stored in the nonvolatile memory after replacing the film-shaped medium with a new film-shaped medium, and control the motor driver to supply the supply current with the read value of supply current.

Moreover, the apparatus is further provided with a temperature detector that detects an ambient temperature of the DC motor, and the controller may apply the calculated rotation velocity to a beforehand determined relationship between the rotation velocity and the temperature to make a temperature correction to the rotation velocity at a predetermined temperature.

Further, the DC motor is comprised of a first DC motor that rotates the supply spool, and a second DC motor that rotates the wind-up spool, and the controller may calculate the rotation velocity of the first DC motor by driving the first DC motor to rotate in the same direction as a rotation direction for transporting the film-shaped medium from the supply spool side to the wind-up spool side, sag the film-shaped medium by driving the second DC motor to rotate in a direction opposite to the rotation direction for transporting the film-shaped medium from the supply spool side to the wind-up spool side, while halting driving of the first DC motor, and calculate the rotation velocity of the second DC motor by driving the second motor to rotate in the same direction as the rotation direction for transporting the film-shaped medium. Alternatively, the controller may sag the film medium by driving the second motor to rotate in a direction opposite to the rotation direction for transporting the film-shaped medium from the supply spool side to the wind-up spool side, calculate the rotation velocity of the second DC motor by driving the second motor to rotate in the same direction as the rotation direction for transporting the film-shaped medium, and calculate the rotation velocity of the first DC motor by driving the first motor in the same direction as the rotation direction for transporting the film-shaped medium from the supply spool side to the wind-up spool side, while halting driving of the second motor.

Moreover, the apparatus is further provided with the mark detector that detects an empty mark indicative of a use limit of the film-shaped medium attached to an end portion of the film-shaped medium, in the film-shaped medium is formed a weak portion on the end side closer to the end than the position in which the empty mark is attached, the DC motor is comprised of the first DC motor that rotates the supply spool and the second DC motor that rotates the wind-up spool, and after the mark detector detects the empty mark, the controller may calculate the rotation velocity of the first DC motor by driving the first motor to rotate in the same direction as the rotation direction for transporting the film-shaped medium from the supply spool side to the wind-up spool side, drive the second motor to rotate in the same direction as the rotation direction for transporting the film-shaped medium while halting driving of the first motor to wind up the film-shaped medium with the wind-up spool, drive the first motor to rotate in a direction opposite to the rotation direction for transporting the film-shaped medium to break the film-shaped medium in the weak portion, further wind up the broken weak portion of the film-shaped medium with the wind-up spool, and calculate the rotation velocity of the second DC motor by driving the second motor to rotate in the same direction as the rotation direction for transporting the film-shaped medium, while halting driving of the first motor.

Advantageous Effect of the Invention

According to the present invention, since the rotation velocity of the DC motor is calculated by driving the DC motor without the tension due to the film-shaped medium being applied, it is possible to properly correct the supply current of the DC motor, and therefore, it is possible to obtain the effect of preventing the image quality from deteriorating.

BRIEF DESCRIPTION OF DRAWINGS

FIG. 17A shows a state in which a sensor detects an empty mark, FIG. 17B shows a state of measuring a rotation velocity of a motor for rotating the supply spool with an ink ribbon sagged, FIG. 17C shows a state in which the sagged ink ribbon is wound up by the motor for rotating the supply spool, FIG. 17D shows a state in which the ink ribbon is sagged by rotating backward a motor for rotating the wind-up spool, and FIG. 17E shows a state of measuring a rotation velocity of the motor for rotating the wind-up spool with the ink ribbon sagged;

FIG. 18A shows a state in which the sensor detects an empty mark, FIG. 18B shows a state of measuring the rotation velocity of the motor for rotating the supply spool with the ink ribbon sagged, FIG. 18C shows a state in which the sagged ink ribbon is wound up by the motor for rotating the wind-up spool, FIG. 18D shows a state in which a weak portion of the ink ribbon is broken by rotating backward the motor for rotating the supply spool, while rotating the motor for rotating the wind-up spool, and FIG. 18E shows a state of measuring the rotation velocity of the motor for rotating the wind-up spool with the ink ribbon wound up;

BEST MODE FOR CARRYING OUT THE INVENTION

With reference to drawings, described below are Embodiments in which the present invention is applied to a printing apparatus for printing and recording text and image on a card, while performing magnetic or electric information recording on the card.

<System Configuration>

Figure 1:
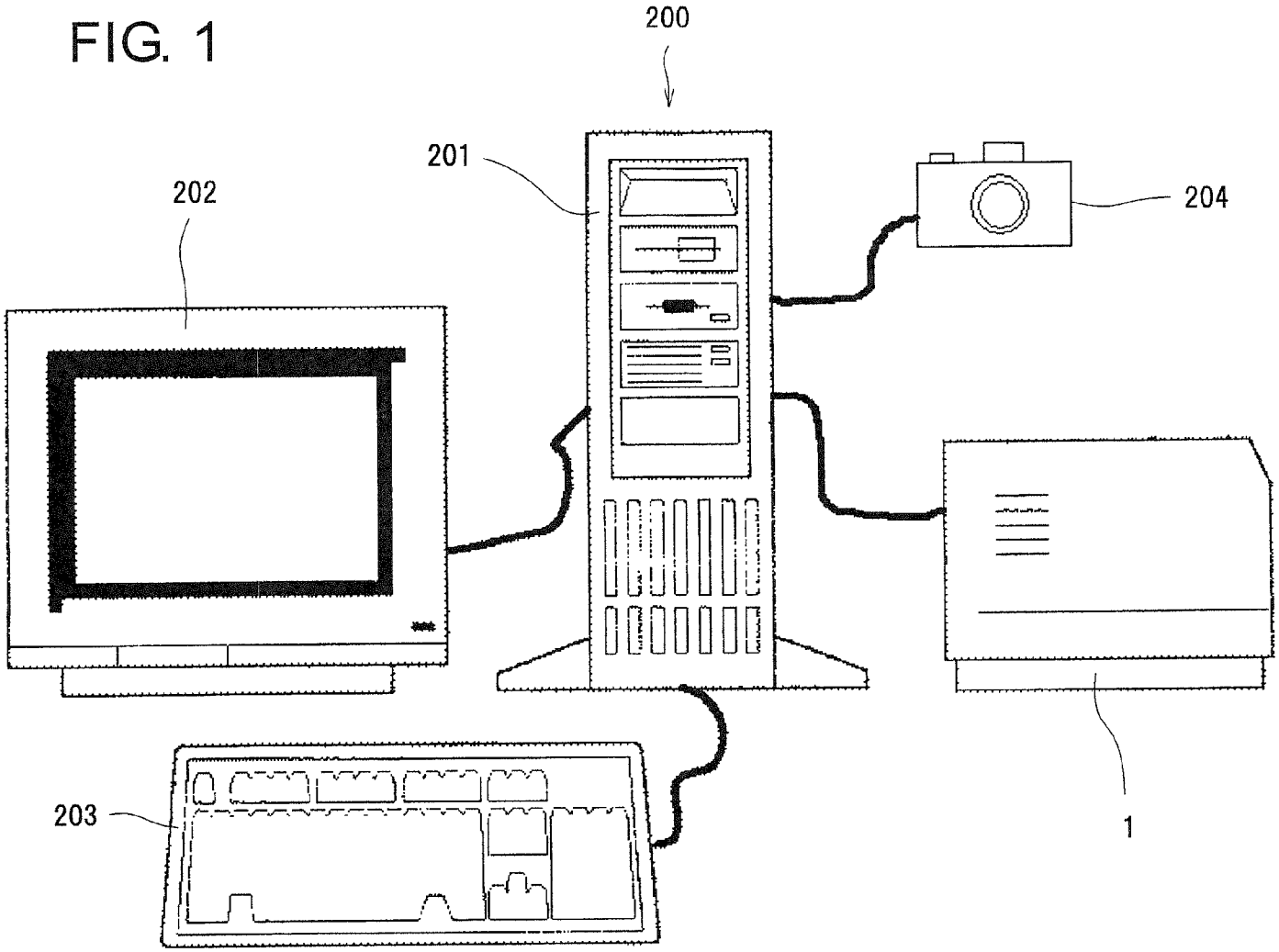
FIG. 1 is an outside view of a printing system including a printing apparatus of an Embodiment to which the present invention is applicable.
Figure 13:
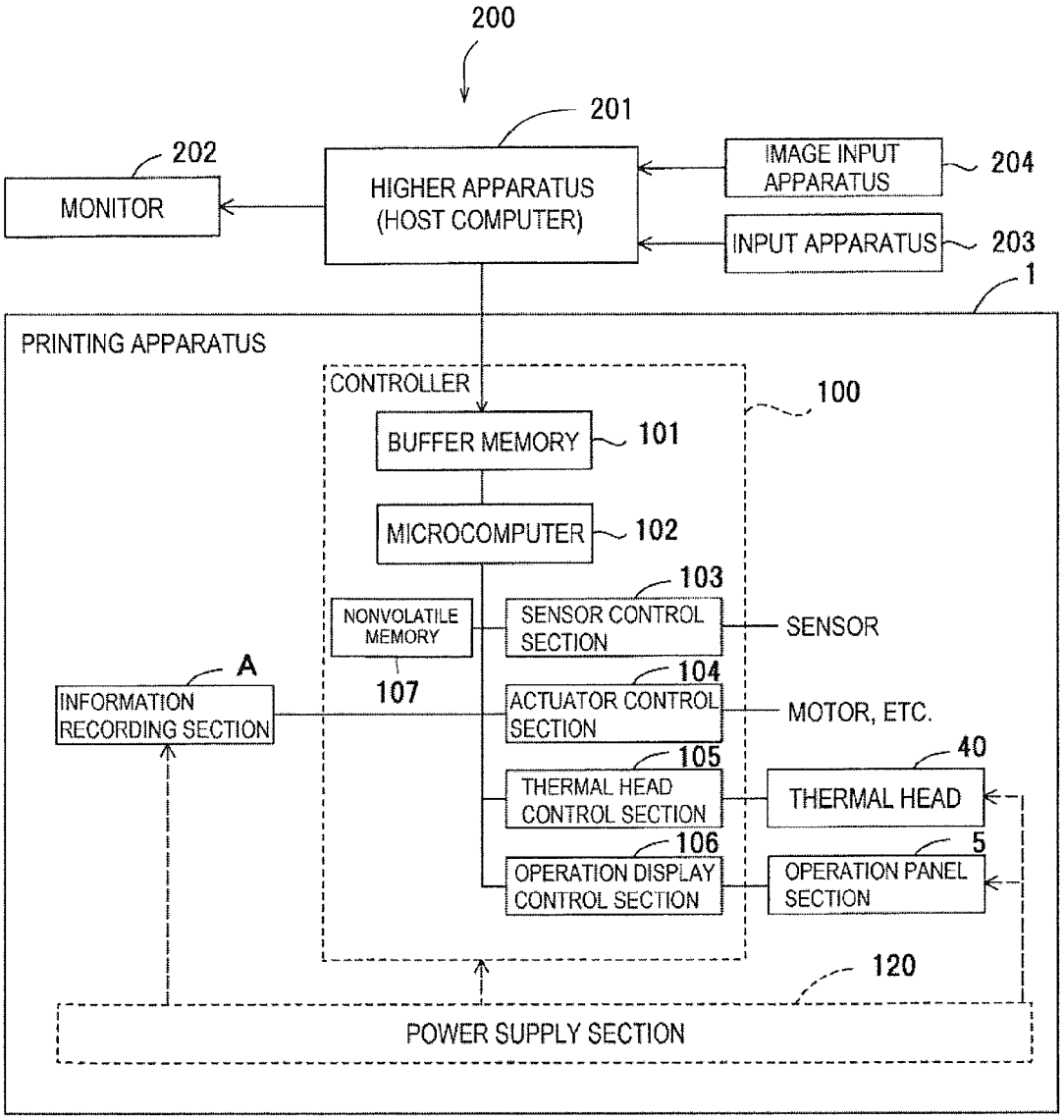
FIG. 13 is a block diagram illustrating a schematic configuration of a controller in the printing apparatus of this Embodiment.

As shown in FIGS. 1 and 13, a printing apparatus 1 of this Embodiment constitutes a part of a printing system 200. In other words, the printing system 200 is broadly comprised of a higher apparatus 201 (for example, host computer such as a personal computer), and the printing apparatus 1.

The printing apparatus 1 is connected to the higher apparatus 201 via an interface with the figure omitted, and the higher apparatus 201 is capable of transmitting image data, magnetic or electric recording data and the like to the printing apparatus 1 to indicate recording operation and the like. In addition, the printing apparatus 1 has an operation panel section (operation display section) 5 (see FIG. 13), and as well as recording operation indication from the higher apparatus 201, recording operation is also capable of being indicated from the operation panel section 5.

The higher apparatus 201 is connected to an image input apparatus 204 such as a digital camera and scanner, an input apparatus 203 such as a keyboard and mouse to input commands and data to the higher apparatus 201, and a monitor 202 such as a liquid crystal display to display data and the like generated in the higher apparatus 201.

<Printing Apparatus>

Figure 2:
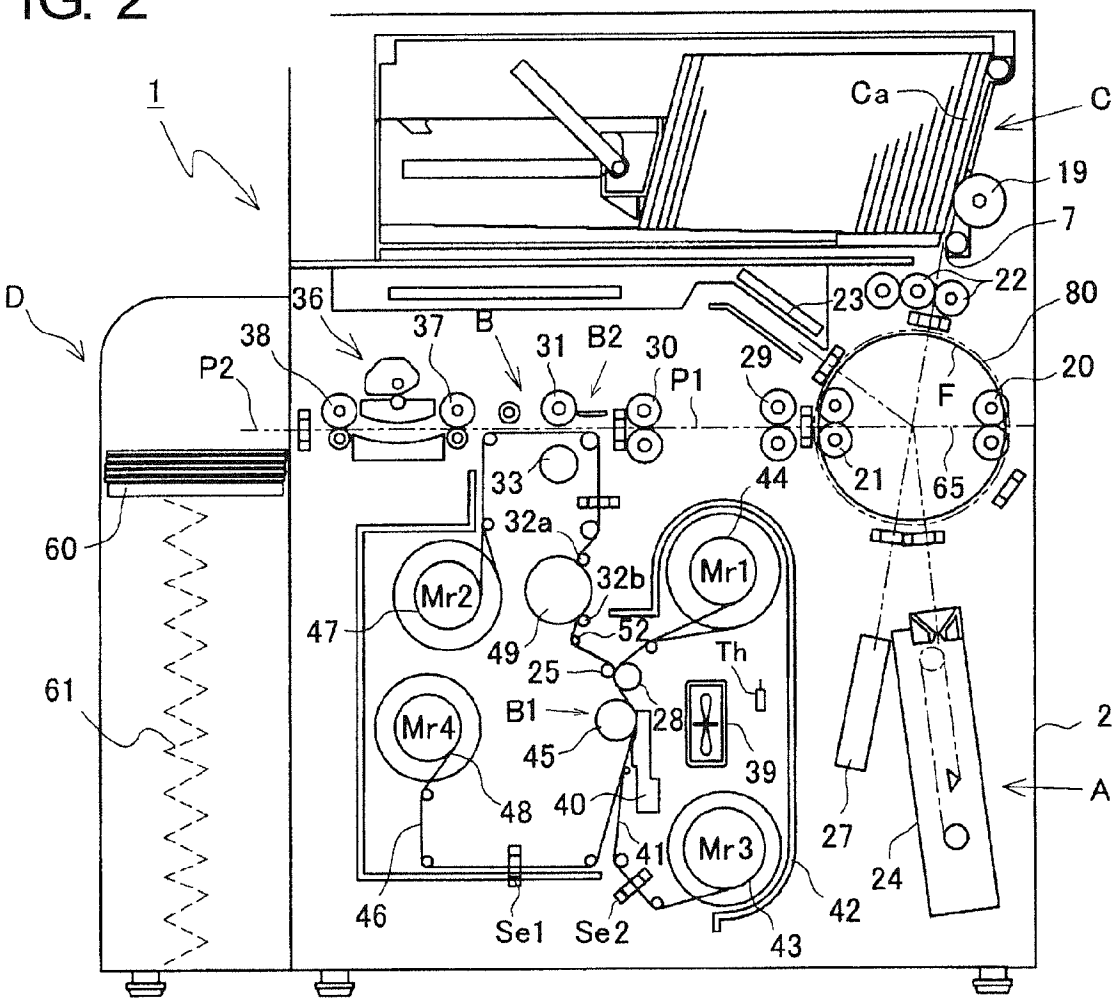
FIG. 2 is a schematic configuration view of the printing apparatus of the Embodiment.

As shown in FIG. 2, the printing apparatus 1 has a housing 2, and in the housing 2 are provided an information recording section A, printing section B, media storage section C, storage section D and rotating unit F.

(Information Recording Section)

The information recording section A is comprised of a magnetic recording section 24, non-contact type IC recording section 23, and contact type IC recording section 27.

(Media Storage Section)

The media storage section C aligns and stores a plurality of cards in a standing posture, is provided at its front end with a separation opening 7, and feeds and supplies sequentially starting with the card in the front row with a pickup roller 19.

(Rotating Unit)

The fed blank card Ca is first sent to a reverse unit F with carry-in rollers 22. The reverse unit F is comprised of a rotating frame 80 bearing-supported by the housing 2 to be turnable, and two roller pairs 20, 21 supported on the frame. Then, the roller pairs 20, 21 are axially supported by the rotating frame 80 to be rotatable.

In the outer region of the rotating reverse unit F are disposed the above-mentioned magnetic recording section 24, non-contact type IC recording section 23, and contact type IC recording section 27. Then, the roller pairs 20, 21 form a medium transport path 65 for transporting the card Ca toward one of the information recording sections 23, 24 and 27, and data is magnetically or electrically written on the card Ca in the recording sections.

(Printing Section)

The printing section B is to form an image such as a photograph of face and text data on the frontside and backside of the card Ca, and a medium transport path P1 for carrying the card Ca is provided on an extension of the medium transport path 65. Further, in the medium transport path P1 are disposed transport rollers 29, 30 that transport the card Ca, and the rollers are coupled to a transport motor not shown.

The printing section B has a film-shaped medium transport mechanism, and is provided with an image formation section B1 that forms an image, with a thermal head 40, on a transfer film 46 transported with the transport mechanism, and a transfer section B2 that subsequently transfers the image formed on the transfer film 46 to the surface of the card Ca on the medium transport path P1 with a heat roller 33.

On the downstream side of the printing section B is provided a medium transport path P2 for carrying the printed card Ca to a storage stacker 60. In the medium transport path P2 are disposed transport rollers 37, 38 that transport the card Ca, and the rollers are coupled to a transport motor not shown.

A decurl mechanism 36 is disposed in between the transport roller 37 and the transport roller 38, presses the card center portion held between the transport rollers 37, 38, and thereby corrects curl generated by thermal transfer with the heat roller 33. Therefore, the decurl mechanism 36 is configured to be able to shift to positions in the vertical direction as viewed in FIG. 2 by an up-and-down mechanism including a cam not shown.

(Storage Section)

The storage section D is configured to store cards Ca sent from the printing section B in the storage stacker 60. The storage stacker 60 is configured to shift downward in FIG. 2 with an up-and-down mechanism 61.

(Details of the Printing Section)

Next, the printing section B in the entire configuration of the above-mentioned printing apparatus 1 will be further described specifically.

The transfer film 46 has the shape of a band having a width slightly larger than the width direction of the card Ca, and is formed by layering, from above, an ink reception layer that receives ink of an ink ribbon 41, a transparent protective layer that protects the surface of the ink reception layer, a peeling layer to promote integral peeling of the ink reception layer and protective layer by heat, and a substrate (base film) in this order.

The transfer film 46 is wound up or fed by a wind-up roll or feed roll that rotates inside a transfer film cassette by driving of motor Mr2 or M4, respectively. In other words, in the transfer film cassette, a wind-up spool 47 is disposed in the center of the wind-up roll, a feed spool 48 is disposed in the center of the feed roll, a rotation drive force of the motor Mr2 is transferred to the wind-up spool 47 via a gear not shown, and a rotation derive force of the motor Mr4 is transferred to the feed spool 48 via a gear not shown. A film transport roller 49 is a main drive roller to carry the transfer film 46, and by controlling drive of the roller 49, transport amount and transport halt position of the transfer film 46 are determined. The film transport roller 49 is coupled to a stepping motor not shown. The motors Mr2 and Mr4 are driven also in driving the film transport roller 49, are to wind the transfer film fed from one of the wind-up spool 47 and feed spool 48 by the other one, and are not driven as main transport of the transfer film 46. In addition, forward-backward rotatable DC motors are used for the motors Mr2 and Mr4.

Pinch rollers 32*a* and 32*b* are disposed on the periphery of the film transport roller 49. Although not shown in FIG. 2, the pinch rollers 32*a* and 32*b* are configured to be movable to move and retract with respect to the film transport roller 49, and in a state in the figure, the rollers move to the film transport roller 49 to come into press-contact, and thereby wind the transfer film 46 around the film transport roller 49. By this means, the transfer film 46 undergoes accurate transport by a distance corresponding to the number of revolutions of the film transport roller 49.

The ink ribbon 41 is stored in an ink ribbon cassette 42 in a state in which the ribbon is laid between a supply spool 43 for supplying the ink ribbon 41 and wind-up spool 44 for winding up the ink ribbon 41, the wind-up spool 44 rotates by a drive force of a motor Mr1, and the supply spool 43 rotates by a drive force of a motor Mr3.

Forward-backward rotatable DC motors are used for the motors Mr1 and Mr3. Further, between the motors Mr1 and Mr3 is disposed a temperature sensor Th such as a thermistor that measures ambient temperatures of the motors Mr1 and Mr3.

The ink ribbon 41 is configured by repeating color ribbon panels of Y (Yellow), M (Magenta), and C (Cyan) and a Bk (Black) ribbon panel in the longitudinal direction in a face sequential manner. Further, an empty mark indicative of a use limit of the ink ribbon 41 is attached to an end portion of the ink ribbon 41. "Se2" shown in FIG. 2 denotes a transmission sensor to detect the empty mark. In addition, in this Embodiment, the empty mark is comprised of a single or a plurality of black straight lines continued from one side to the other side in the width direction of the ink ribbon 41, but the present invention is not limited thereto.

A platen roller 45 and thermal head 40 form the image formation section B1, and the thermal head 40 is disposed in a position opposed to the platen roller 45. The thermal head 40 has a plurality of heating elements lined in the main scanning direction, these heating elements are selectively heated and controlled by a head control IC (not shown) according to printing data, and an image is printed on the transfer film 46 via the ink ribbon 41. In addition, a cooling fan 39 is to cool the thermal head 40.

The ink ribbon 41 with which printing on the transfer film 46 is finished is peeled off from the transfer film 46 with a peeling roller 25 and peeling member 28. The peeling member 28 is fixed to the ink ribbon cassette 42, the peeling roller 25 comes into contact with the peeling member 28 in printing, and the roller 25 and member 28 nip the transfer film 46 and ink ribbon 41 to peel. Then, the peeled ink ribbon 41 is wound around the wind-up spool 44 by the drive force of the motor Mr1, and the transfer film 46 is transported to the transfer section B2 having the platen roller 31 and heat roller 33 by the film transport roller 49.

In the transfer section B2, the transfer film 46 is nipped together with the card Ca by the heat roller 33 and platen roller 31, and the image on the transfer film 46 is transferred to the card surface. In addition, the heat roller 33 is attached to an up-and-down mechanism (not shown) so as to come into contact with and separate from the platen roller 31 via the transfer film 46.

Figure 3:
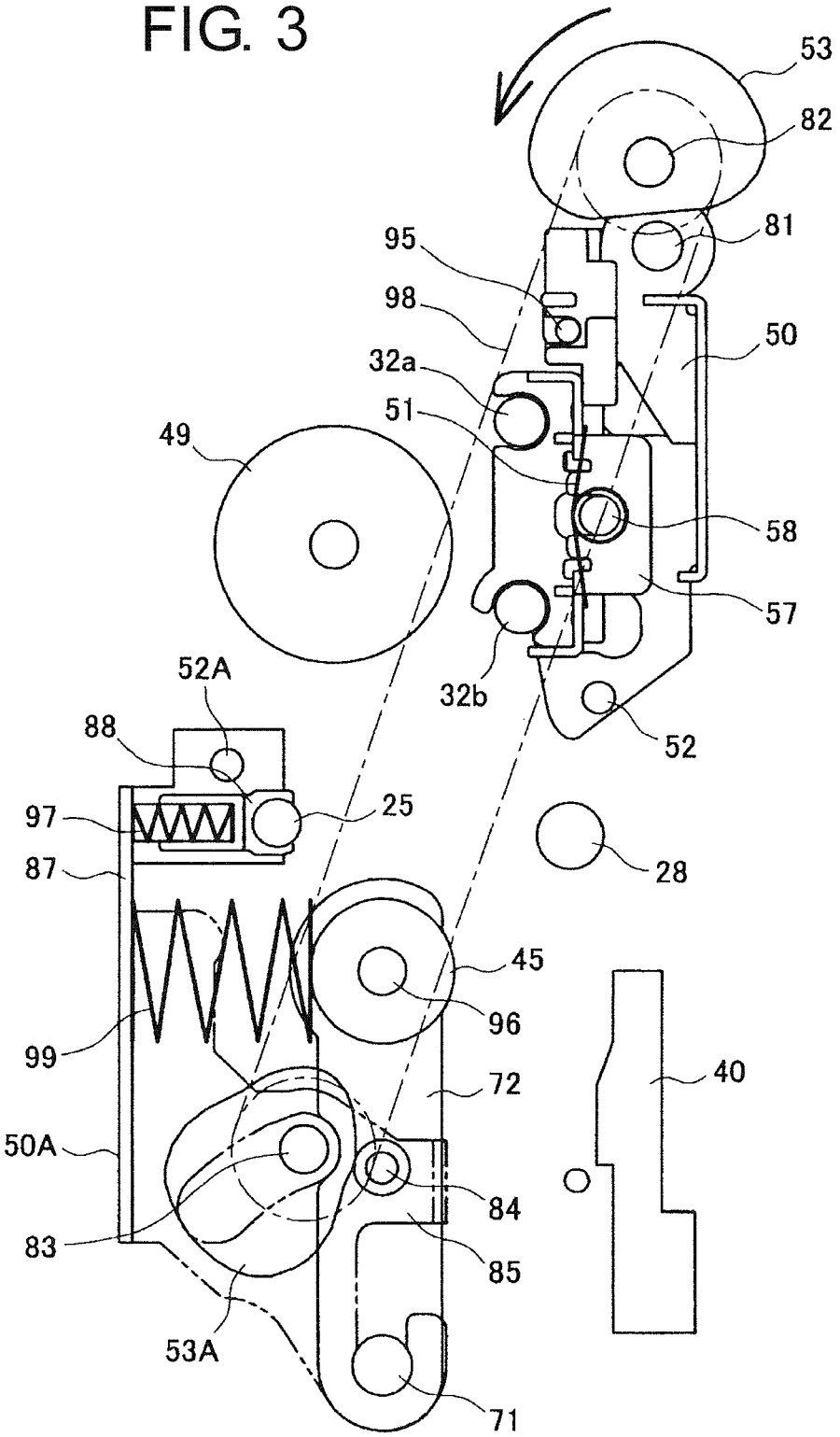
FIG. 3 is an explanatory view of a control state by a cam in a waiting position in which pinch rollers and film transport roller are separated from each other, and a platen roller and thermal head are separated from each other.
Figure 4:
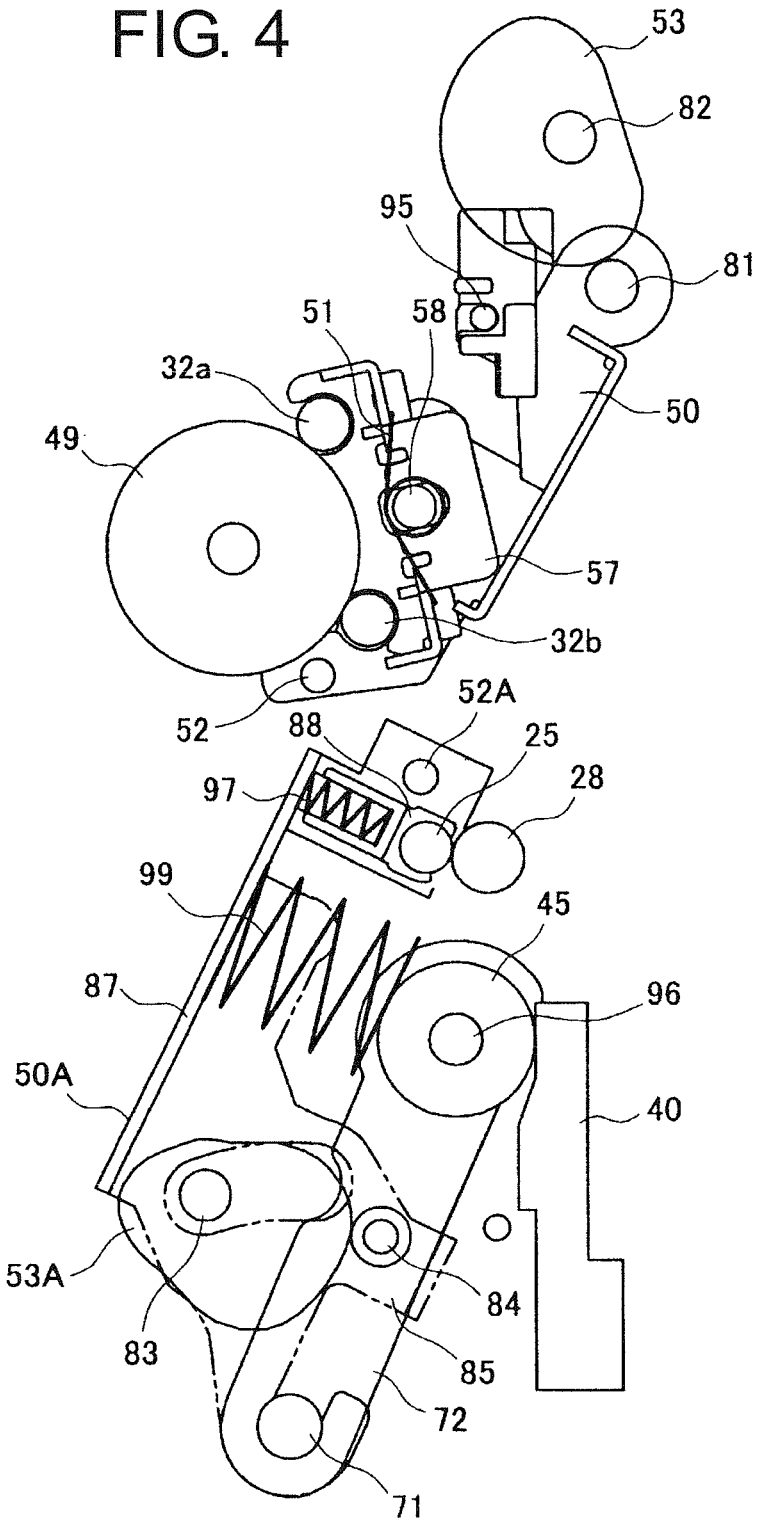
FIG. 4 is an explanatory view of a control state by the cam in a printing position in which the pinch rollers and film transport roller are brought into contact with each other, and the platen roller and thermal head are brought into contact with each other.
Figure 5:
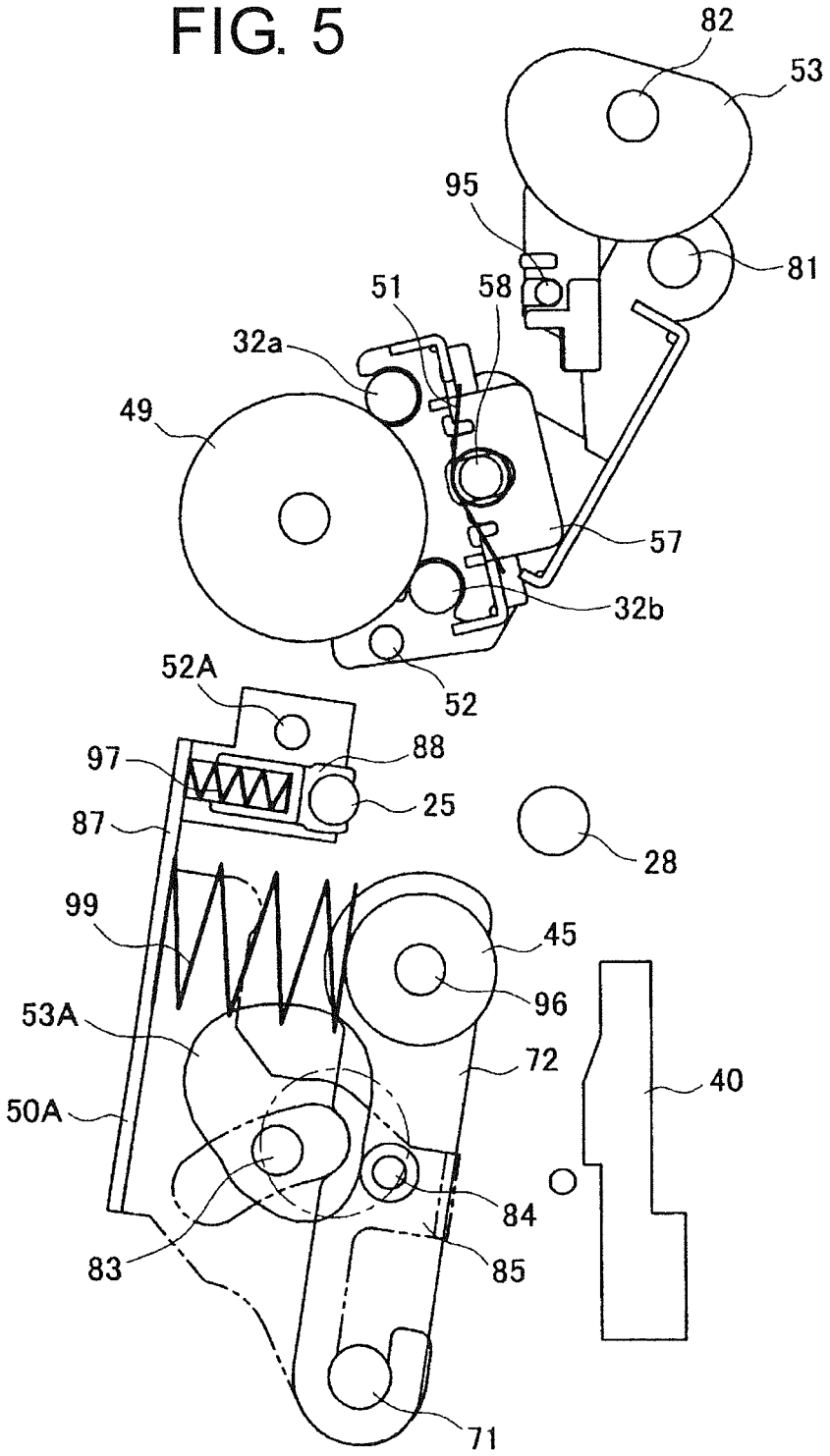
FIG. 5 is an explanatory view of a control state by the cam in a transport position in which the pinch rollers and film transport roller are brought into contact with each other, and the platen roller and thermal head are brought into contact with each other.
Figure 10:
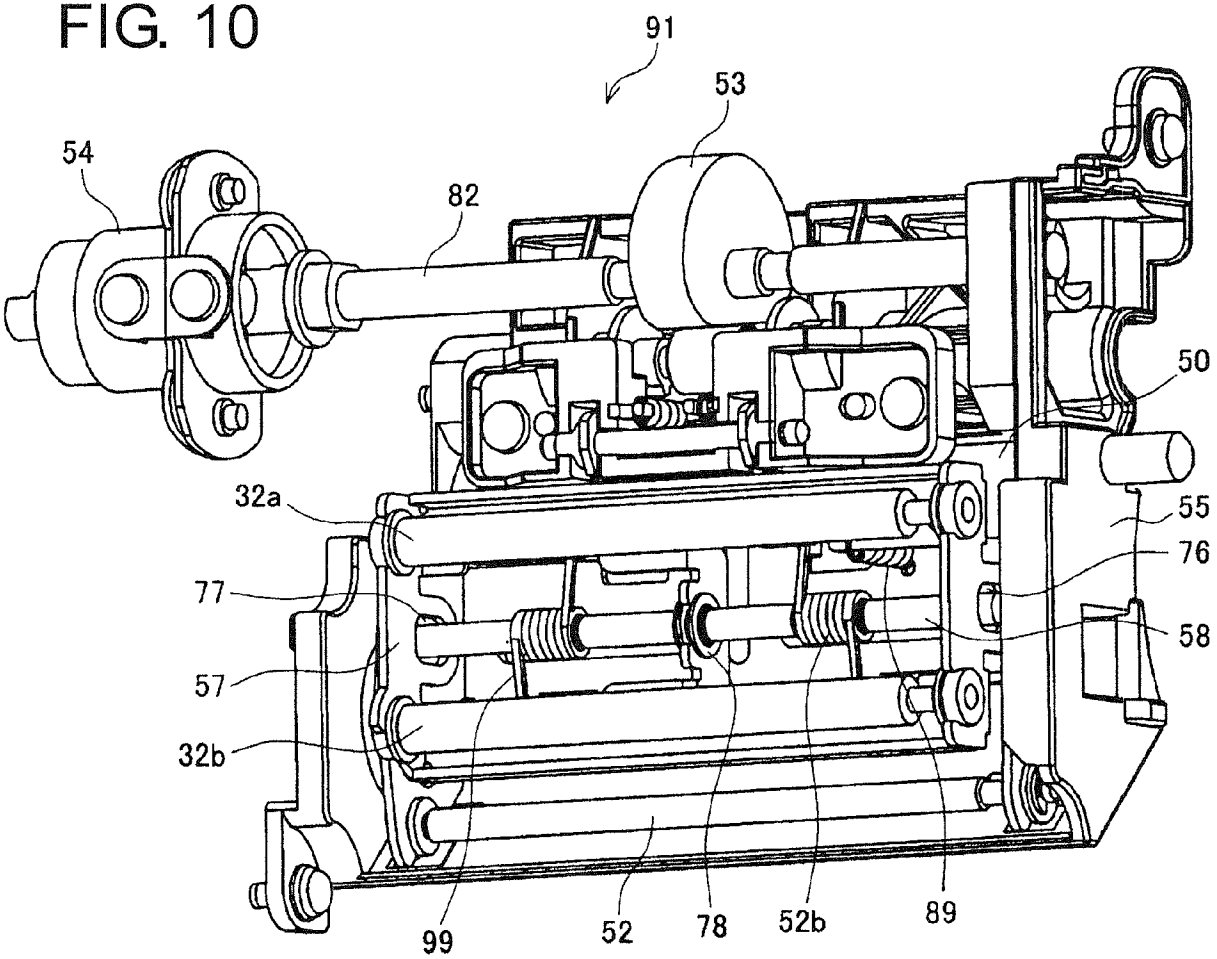
FIG. 10 is an outside view showing a configuration of a second unit integrated to incorporate the pinch rollers and their peripheral parts into the printing apparatus.

The configuration of the image formation section B1 will specifically be described further together with its action. As shown in FIGS. 3 to 5, the pinch rollers 32*a*, 32*b* are respectively supported by an upper end portion and lower end portion of a pinch roller support member 57, and the pinch roller support member 57 is supported rotatably by a support shaft 58 penetrating the center portion of the member 57. As shown in FIG. 10, the support shaft 58 is laid at its opposite end portions between long holes 76, 77 formed in the pinch roller support member 57, and is at its center portion fixed to a fix portion 78 of a bracket 50. Further, the long holes 76, 77 are provided with spaces in the horizontal direction and vertical direction with respect to the support shaft 58. By this means, it is made possible to adjust the pinch rollers 32*a*, 32*b* with respect to the film transport roller 49, described later.

Spring members 51 (51*a*, 51*b*) are mounted on the support shaft 58, and end portions on which the pinch rollers 32*a*, 32*b* are installed of the pinch roller support member 57 respectively contact the spring members 51, and are biased to the direction of the film transport roller 49 by the spring forces.

The bracket 50 comes into contact with the cam operation surface of a cam 53 in a cam receiver 81, and is configured to shift in the horizontal direction viewed in the figure with respect to the film transport roller 49, corresponding to rotation in the arrow direction of the cam 53 with a cam shaft 82 as the axis rotating by drive force of a drive motor 54 (see FIG. 10). Accordingly, when the bracket 50 moves toward the film transport roller 49 (FIGS. 4 and 5), the pinch rollers 32*a*, 32*b* come into press-contact with the film transport roller 49 against the spring members 51 with the transfer film 46 nipped, and wind the transfer film 46 around the film transport roller 49.

At this point, the pinch roller 32*b* in a farther position from a shaft 95 as a rotation axis of the bracket 50 first comes into press-contact with the film transport roller 49, and next, the pinch roller 32*a* comes into press-contact. In this way, by arranging the shaft 95 that is the rotation axis higher than the film transport roller 49, the pinch roller support member 57 comes into contact with the film transport roller 49 while rotating, instead of parallel shift, and there is the advantage that the space in the width direction is less than in the parallel shift.

Further, the press-contact forces when the pinch rollers 32*a*, 32*b* come into press-contact with the film transport roller 49 are uniform in the width direction of the transfer film 46 by the spring members 51. At this point, since the long holes 76, 77 are formed on the opposite sides of the pinch roller support member 57 and the support shaft 58 is fixed to the fix portion 78, it is possible to adjust the pinch roller support member 57 in three directions, and the transfer film 46 is transported in a correct posture by rotation of the film transport roller 49 without causing skew. In addition, adjustments in three directions described herein are to (i) adjust the parallel degree in the horizontal direction of the shafts of the pinch rollers 32*a*, 32*b* with respect to the shaft of the film transport roller 49 to uniform the press-contact forces in the shaft direction of the pinch rollers 32*a*, 32*b* with respect to the film transport roller 49, (ii) adjust shift distances of the pinch rollers 32*a*, 32*b* with respect to the film transport roller 49 to uniform the press-contact force of the pinch roller 32*a* on the film transport roller 49 and the press-contact force of the pinch roller 32*b* on the film transport roller 49, and (iii) adjust the parallel degree in the vertical direction of the shafts of the pinch rollers 32*a*, 32*b* with respect to the shaft of the film transport roller 49 so that the shafts of the pinch rollers 32*a*, 32*b* are perpendicular to the film travel direction.

Furthermore, the bracket 50 is provided with a tension receiving member 52 that comes into contact with a portion of the transfer film 46 which is not wound around the film transport roller 49 when the bracket 50 moves toward the film transport roller 49.

The tension receiving member 52 is provided to prevent the pinch rollers 32*a*, 32*b* from retracting from the film transport roller 49 respectively against the biasing forces of the spring members 51 due to the tension of the transfer film 46 occurring when the pinch rollers 32*a*, 32*b* bring the transfer film 46 into press-contact with the film transport roller 49. Accordingly, the tension receiving member 52 is attached to the front end of the end portion on the rotation side of the bracket 50 so as to come into contact with the transfer film 46 in the position to the left of the pinch rollers 32*a*, 32*b* viewed in the figure. FIG. 2 shows a state in which the tension receiving member 52 is brought into contact with the transfer film 46.

By this means, the cam 53 is capable of directly receiving the tension occurring due to elasticity of the transfer film 46 through the tension receiving member 52. Accordingly, the pinch rollers 32*a*, 32*b* are prevented from retracting from the film transport roller 49 due to the tension and from decreasing the press-contact forces of the pinch rollers 32*a*, 32*b*, thereby maintain the winding state in which the transfer film 46 is brought into intimate contact with the film transport roller 49, and are able to perform accurate transport.

Figure 9:
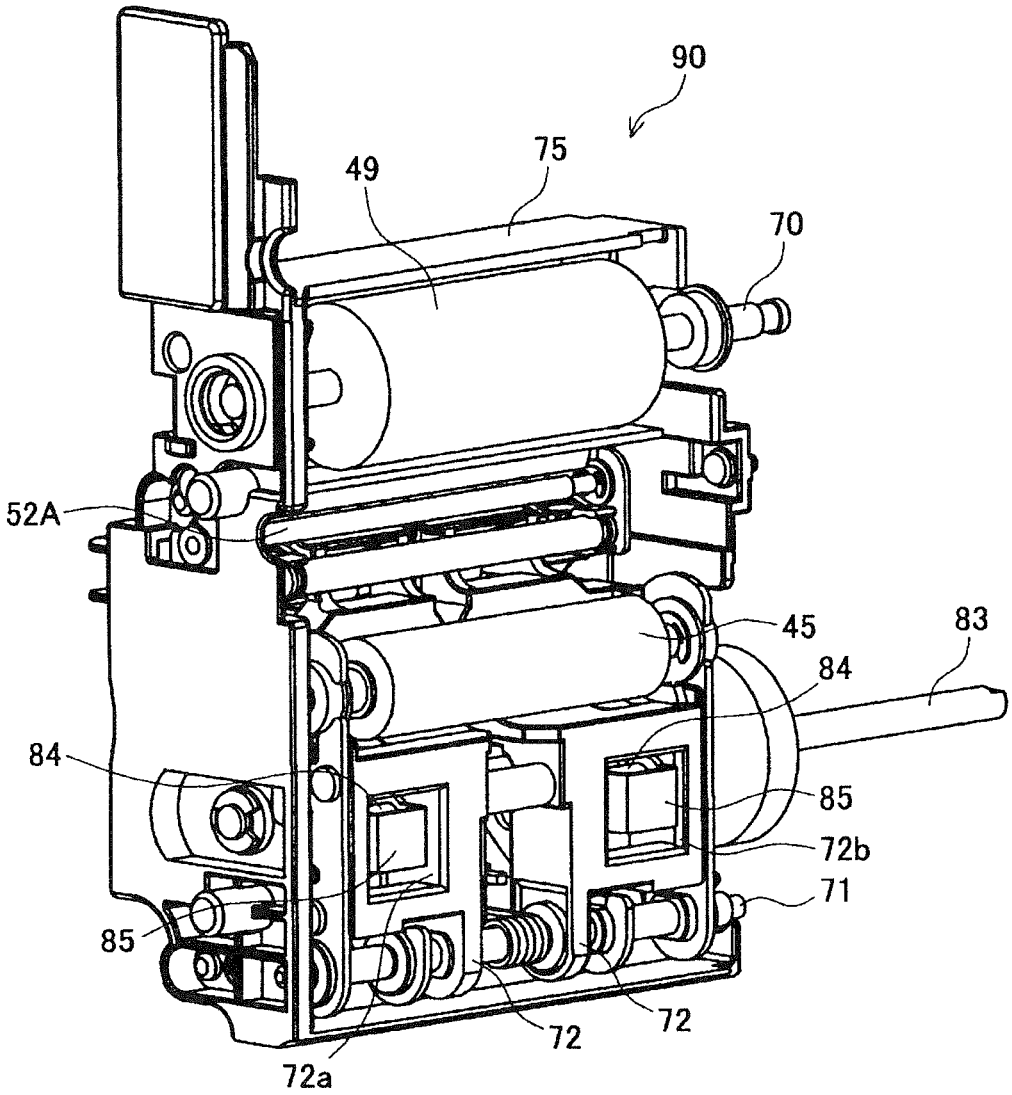
FIG. 9 is an outside view showing a configuration of a first unit integrated to incorporate the film transport roller, platen roller and their peripheral parts into the printing apparatus.

As shown in FIG. 9, the platen roller 45 disposed along the transverse width direction of the transfer film 46 is supported by a pair of platen support members 72 rotatable on a shaft 71 as the axis. The pair of platen support members 72 support opposite ends of the platen roller 45. The platen support members 72 are respectively connected to end portions of a bracket 50A having the shaft 71 as a common rotating shaft via spring members 99.

The bracket 50A has a substrate 87, and cam receiver support portion 85 formed by bending the substrate 87 in the direction of the platen support member 72, and the cam receiver support portion 85 holds a cam receiver 84. A cam 53A rotating on a cam shaft 83 as the axis driven by the drive motor 54 is disposed between the substrate 87 and the cam receiver support portion 85, and is configured so that the cam operation surface and cam receiver 84 come into contact with each other. Accordingly, when the bracket 50A moves in the direction of the thermal head 40 by rotation of the cam 53A, the platen support members 72 also shift to bring the platen roller 45 into press-contact with the thermal head 40.

The spring members 99 and cam 53A are thus disposed vertically between the bracket 50A and platen support members 72, and it is thereby possible to store a platen shift unit within the distance between the bracket 50A and platen support members 72. Further, the width direction is held within the width of the platen roller 45, and it is possible to save space.

Moreover, since the cam receiver support portion 85 is fitted into bore portions 72*a*, 72*b* (see FIG. 9) formed in the platen support members 72, even when the cam receiver support portion 85 is formed while protruding in the direction of the platen support members 72, the distance between the bracket 50A and the platen support members 72 is not increased, and also in this respect, it is possible to save space.

When the platen roller 45 comes into press-contact with the thermal head 40, the spring members 99 connected to respective platen support members 72 act each so as to uniform the press-contact force on the width direction of the transfer film 46. Therefore, when the transfer film 46 is transported by the film transport roller 49, the skew is prevented, and it is possible to perform image formation on the transfer film 46 by the thermal head 40 accurately without the printing region of the transfer film 46 shifting in the width direction.

The substrate 87 of the bracket 50A is provided with a pair of peeling roller support members 88 for supporting opposite ends of the peeling roller 25 via spring members 97, and when the bracket 50A moves to the thermal head 40 by rotation of the cam 53A, the peeling roller 25 comes into contact with the peeling member 28 to peel off the transfer film 46 and ink ribbon 41 nipped between the roller and member. The peeling roller support members 88 are also provided respectively at opposite ends of the peeling roller 25 as in the platen support members 72, and are configured so as to uniform the press-contact force in the width direction on the peeling member 28.

A tension receiving member 52A is provided in an end portion on the side opposite to the end portion on the shaft support 59 side of the bracket 50A. The tension receiving member 52A is provided to absorb the tension of the transfer film 46 occurring in bringing the platen roller 45 and peeling roller 25 respectively into press-contact with the thermal head 40 and peeling member 28. The spring members 99 and 97 are provided so as to uniform the press-contact force on the width direction of the transfer film 46, and in order for the spring members 99 and 97 not to be inversely behind the tension of the transfer film 46 and decrease the press-contact force on the transfer film 46, the tension receiving member 52A receives the tension from the transfer film 46. In addition, since the tension receiving member 52A is also fixed to the bracket 50A as in the above-mentioned tension receiving member 52, the cam 53A receives the tension of the transfer film 46 via the bracket 50A, and is not behind the tension of the transfer film 46. By this means, the press-contact force of the thermal head 40 and platen roller 45 and the press-contact force of the peeling member 28 and peeling roller 25 are held, and it is thereby possible to perform excellent printing and peeling. Further, any error does not occur in the transport amount of the transfer film 46 in driving the film transport roller 49, the transfer film 46 corresponding to the length of the printing region is accurately transported to the thermal head 40, and it is possible to perform printing with accuracy.

The cam 53 and cam 53A are driven by same drive motor 54 with a belt 98 (see FIG. 3) laid therebetween.

Figure 6:
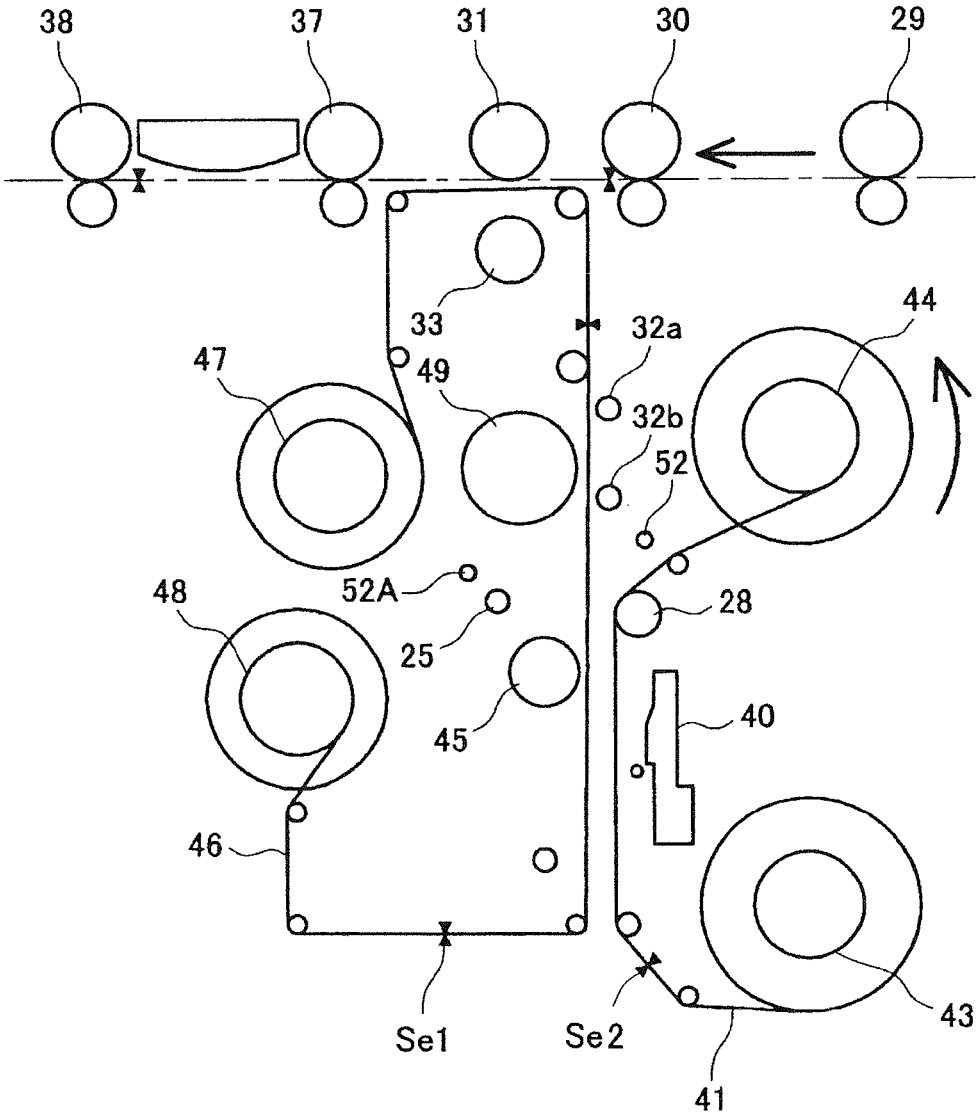
FIG. 6 is an operation explanatory view to explain the state of the waiting position in the printing apparatus.

When the printing section B is in a waiting position as shown in FIG. 6, the cam 53 and cam 53A are in the state as shown in FIG. 3, the pinch rollers 32*a*, 32*b* are not brought into press-contact with the film transport roller 49, and the platen roller 45 is not brought into press-contact with the thermal head 40 either. In other words, in the waiting position, the platen roller 45 and thermal head 40 are positioned in separate positions in which the roller 45 and head 40 are separate.

Figure 7:
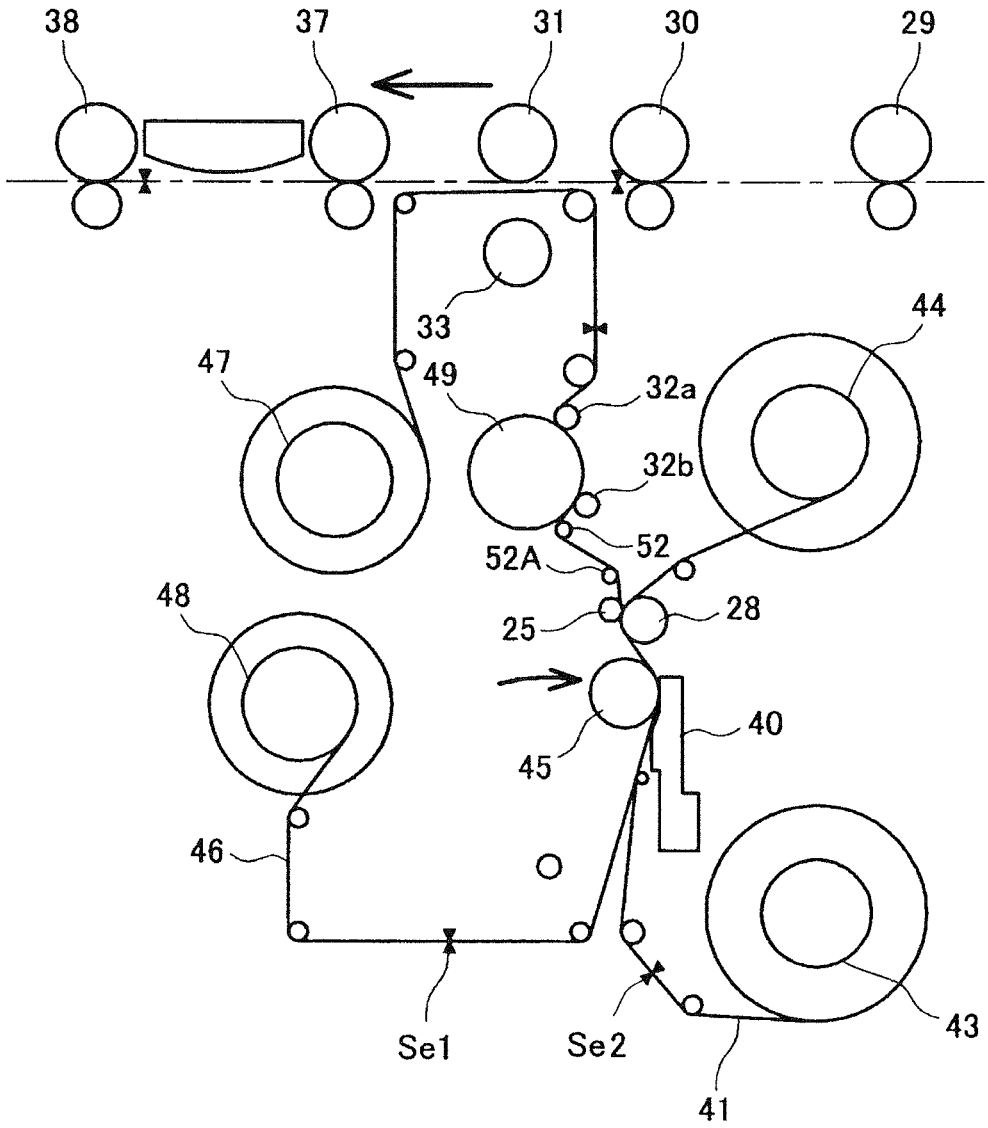
FIG. 7 is an operation explanatory view to explain the state of the transport position in the printing apparatus.

Then, when the cam 53 and cam 53A are rotated in conjunction with each other and are in the state as shown in FIG. 4, the printing section B shifts to a printing position as shown in FIG. 7. At this point, the pinch rollers 32*a*, 32*b* first wind the transfer film 46 around the film transport roller 49, and concurrently, the tension receiving member 52 comes into contact with the transfer film 46. Subsequently, the platen roller 45 comes into press-contact with the thermal head 40. In this printing position, the platen roller 45 shifts toward the thermal head 40 to nip the transfer film 46 and ink ribbon 41 and come into press-contact, and the peeling roller 25 is in contact with the peeling member 28.

In this state, when transport of the transfer film 46 is started by rotation of the film transport roller 49, at the same time, the ink ribbon 41 is also wound around the wind-up spool 44 by operation of the motor Mr1 and transported in the same direction. During this transport, a positioning mark provided in the transfer film 46 passes through a sensor Se1 and shifts a predetermined amount, and at the time the transfer film 46 arrives at a printing start position, printing by the thermal head 40 is performed on the predetermined region of the transfer film 46. Particularly, since the tension of the transfer film 46 is large during printing, the tension of the transfer film 46 acts on the direction for separating the pinch rollers 32*a*, 32*b* from the film transport roller 49 and the direction for separating the peeling roller 25 and platen roller 45 from the peeling member 28 and thermal head 40. However, as described above, since the tension of the transfer film 46 is received in the tension receiving members 52, 52A, the press-contact forces of the pinch rollers 32*a*, 32*b* are not decreased, it is thereby possible to perform accurate film transport, the press-contact force of the thermal head 40 and platen roller 45 and the press-contract force of the peeling member 28 and peeling roller 25 are not decreased either, and it is thereby possible to perform accurate printing and peeling. The ink ribbon 41 with which printing is finished is peeled off from the transfer film 46 and wound around the wind-up spool 44.

A shift amount by transport of the transfer film 46 i.e. a length in the transport direction of a printing region to undergo printing is detected by an encoder (not shown) provided in the film transport roller 49, rotation of the film transport roller 49 is halted corresponding to detection, and at the same time, winding by the wind-up spool 44 by operation of the motor Mr1 is also halted. By this means, finished is printing with the ink of the first ink panel on the printing region of the transfer film 46.

Figure 8:
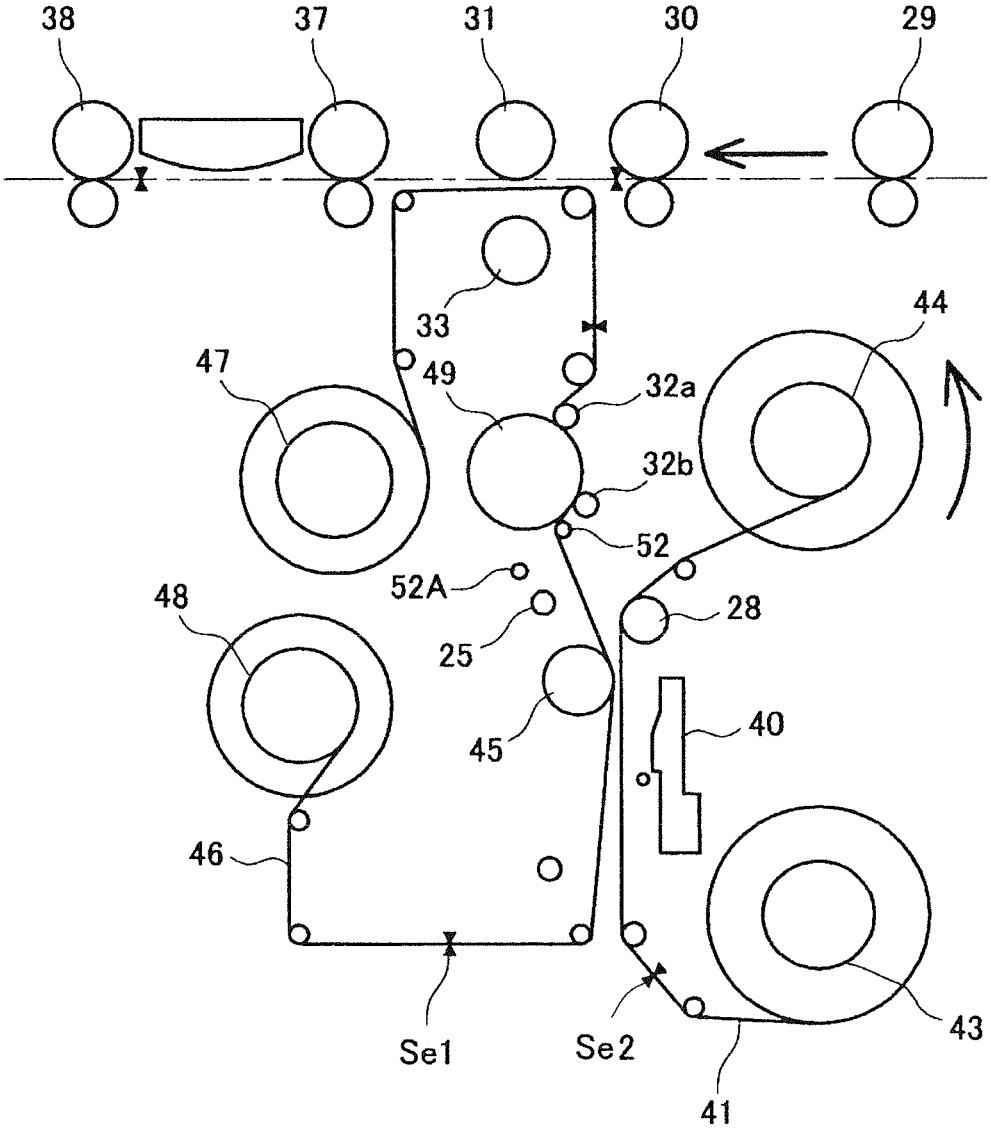
FIG. 8 is an operation explanatory view to explain the state of the printing position in the printing apparatus.

Next, when the cam 53 and cam 53A are further rotated in conjunction with each other and are in the state as shown in FIG. 5, the printing section B shifts to a transport position as shown in FIG. 8, and the platen roller 45 returns to the direction of retracting from the thermal head 40. In this state, the pinch rollers 32*a*, 32*b* still wind the transfer film 46 around the film transport roller 49, the tension receiving member 52 is in contact with the transfer film 46, and the transfer film 46 is transported backward to an initial position by rotation in the backward direction of the film transport roller 49. Also at this point, the shift amount of the transfer film 46 is controlled by rotation of the film transport roller 49, and the transfer film 46 is transported backward corresponding to the length in the transport direction of the printing region subjected to printing. In addition, the ink ribbon 41 is also rewound a predetermined amount with the motor Mr3, and the ink panel of the ink to print next waits in the initial position (feeding position).

Then, the control state by the cam 53 and cam 53A becomes the state as shown in FIG. 4 again and the printing position as shown in FIG. 7, the platen roller 45 is brought into press-contact with the thermal head 40, the film transport roller 49 rotates in the forward direction again to shift the transfer film 46 corresponding to the length of the printing region, and printing with the ink of the next ink panel is performed with the thermal head 40.

Thus, the operation in the printing position and transport position is repeated until printing with ink of all or predetermined ink panel is finished. Then, when printing with the thermal head 40 is finished, the image-formed region of the transfer film 46 is transported to the heat roller 33, and at this point, the cam 53 and cam 53A shift to the state as shown in FIG. 3, and release press-contact with the transfer film 46. Subsequently, transfer to the card Ca is performed while transporting the transfer film 46 by driving of the wind-up spool 47.

Such a printing section B is divided into three units 90, 91, and 92.

As shown in FIG. 9, in the first unit 90, a unit frame body 75 is installed with a drive shaft 70 that rotates by driving of the motor 54 (see FIG. 10), and the drive shaft 70 is inserted in the film transport roller 49. Below the film transfer film 49 are disposed the bracket 50A and a pair of platen support members 72, and these members are supported rotatably by the shaft 71 laid between opposite side plates of the unit frame body 75.

In FIG. 9, a pair of cam receiver support portions 85 that are a part of the bracket 50A appear from the bore portions 72*a*, 72*b* formed in the platen support members 72. The cam receiver support portions 85 hold a pair of cam receivers 84 disposed at the back thereof. Then, at the back of the cam receivers 84 is disposed the cam 53A installed in the cam shaft 83 inserted in the unit frame body 75. The cam shaft 83 is laid between opposite side plates of the unit frame body 75.

Figure 11:
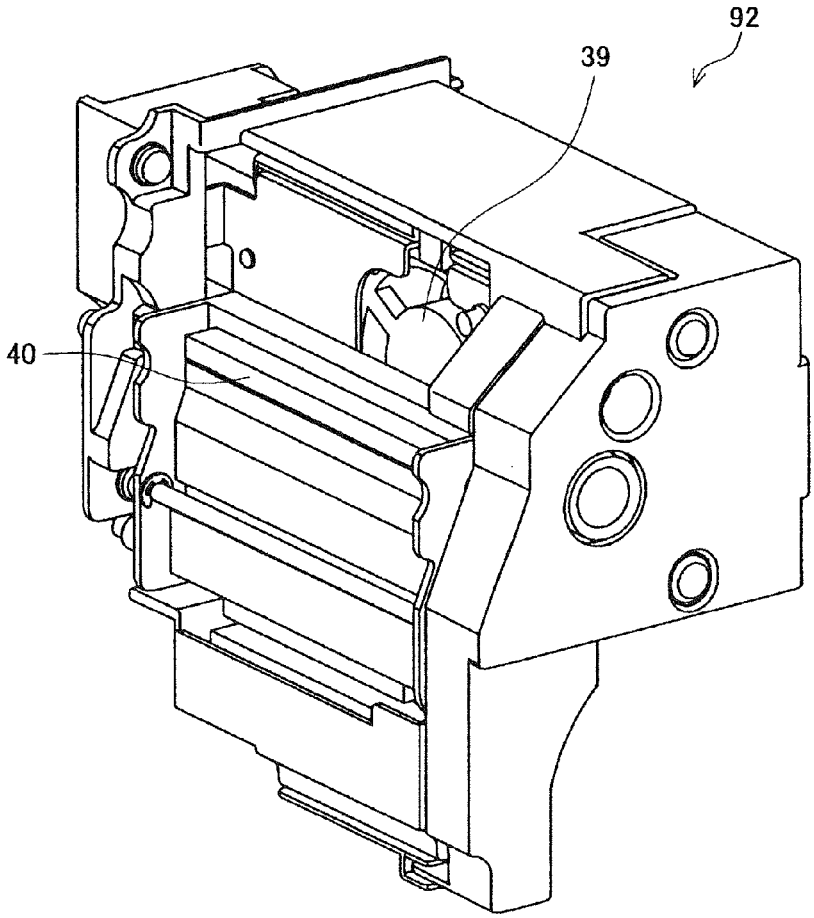
FIG. 11 is an outside view of a third unit integrated to incorporate the thermal head into the printing apparatus.

The above-mentioned thermal head 40 is disposed in the position opposed to the platen roller 45 with a transport path of the transfer film 46 and ink ribbon 41 therebetween. The thermal head 40, members related to heating and cooling fan 39 are integrated into the third unit 92 as shown in FIG. 11, and are disposed opposite the first unit 90.

The first unit 90 collectively holds the platen roller 45, peeling roller 25 and tension receiving member 52A varying in position by printing operation in the movable bracket 50A, and thereby eliminates the need of position adjustments among the members. Moreover, by shifting the bracket 50A by rotation of the cam 53, it is possible to shift the members to predetermined positions. Further, since the bracket 50A is provided, it is possible to store in the same unit as that of the fixed film transport roller 49, the transport drive portion by the film transport roller 49 required to transport the transfer film with accuracy and the transfer position regulation portion by the platen roller 45 are included in the same unit, and therefore, the need is eliminated for position adjustments between both portions.

As shown in FIG. 10, in the second unit 91, the cam shaft 82 installed with the cam 53 is inserted in a unit frame body 55, and is coupled to an output shaft of the drive motor 54. Then, the second unit 91 supports the bracket 50 in the unit frame body 55 movably to come into contact with the cam. 53, and to the bracket 50 are fixed the support shaft 58 that supports the pinch roller support member 57 rotatably and the tension receiving member 52.

In the pinch roller support member 57, the spring members 51*a*, 51*b* are attached to the support shaft 58, and their end portions are respectively brought into contact with the opposite ends of the pinch roller support member 57 that supports the pinch rollers 32*a*, 32*b* to bias to the direction of the film transport roller 49. In the pinch roller support member 57, the support shaft 58 is inserted in the long holes 76, 77, and is fixed and supported in the center portion by the bracket 50.

A spring 89 for biasing the pinch roller support member 57 toward the bracket 50 is provided between the bracket 50 and the pinch roller support member 57. By this spring 89, the pinch roller support member 57 is biased in the direction of moving backward from the film transport roller 49 of the first unit 90, and therefore, it is possible to easily pass the transfer film 46 through between the first unit 90 and the second unit 91 in setting the transfer film cassette in the printing apparatus 1.

The second unit 91 holds the pinch rollers 32*a*, 32*b*, and tension receiving member 52 varying in position corresponding to printing operation in the bracket 50A, shifts the pinch rollers 32*a*, 32*b* and tension receiving member 52 by shifting the bracket 50A by rotation of the cam 53, and thereby simplifies position adjustments between the rollers and member, and position adjustments between the pinch rollers 32*a*, 32*b* and the film transport roller 49. Such a second unit 91 is disposed opposite the first unit 90 with the transfer film 46 therebetween.

By thus making the units, it is also possible to pull each of the first unit 90, second unit 92 and third unit 93 out of the main body of the printing apparatus 1 as in the cassette of each of the transfer film 46 and ink ribbon 41. Accordingly, in replacing the cassette due to consumption of the transfer film 46 or ink ribbon 41, when the units 90, 91 and 92 are pulled out as required, it is possible to install the transfer film 46 or ink ribbon 41 readily inside the apparatus in inserting the cassette.

As described above, by combining the first unit 90 into which are integrated the platen roller 45, bracket 50A, cam 53A, and platen support member 72, and the second unit 91 into which are integrated the pinch rollers 32*a*, 32*b*, bracket 50, cam 53 and spring members 51, and placing and installing the third unit 92 with the thermal head 40 attached thereto opposite the platen roller 45, it is possible to perform assembly in manufacturing the printing apparatus and adjustments in maintenance with ease and accuracy. Moreover, by integrating, it is possible to perform removal from the apparatus with ease, and the handleability as the printing apparatus is improved.

<Relationship Between Spool and Motor>

Described next is the relationship between the spools 43, 44 and motors Mr3 and Mr1 of the ink ribbon cassette 42.

Figure 12:
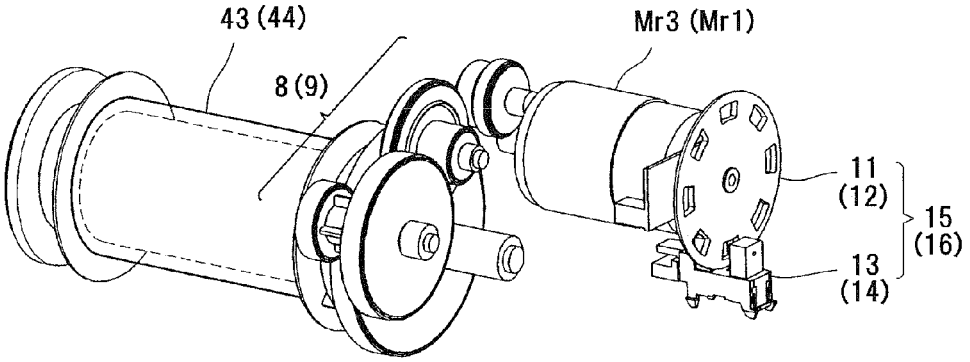
FIG. 12 is an external perspective view showing spools of an ink ribbon cassette, coupling gear group, DC motor and encoder.

As shown in FIG. 12, a gear fitted into the motor shaft is fitted into one side of the motor shaft of the motor Mr3, and a gear with a diameter slightly larger than that of the supply spool 43 is fitted into the rotating shaft of the supply spool 43. The gear fitted into the motor shaft of the motor Mr3 and the gear fitted into the rotating shaft of the supply spool 43 are. coupled with a coupling gear group 8 comprised of a plurality of gears respectively meshing with these gears. Accordingly, by rotating the motor Mr3 forward and backward, the supply spool 43 also rotates forward and backward.

On the other hand, a rotating plate 11 with a plurality of ("8" in this Example) slits (openings) formed at regular intervals is fitted into the other side of the motor shaft of the motor Mr3, and a transmission sensor 13 is disposed corresponding to the positions of the slits. The rotating plate 11 and transmission sensor 13 constitute the encoder 15. Accordingly, by the rotating plate 11 rotating by driving of the motor Mr3, the transmission sensor 13 constituting the encoder 15 outputs signals of ON and OFF (also see FIG. 19).

The relationship between the wind-up spool 44 and the motor Mr1 is the same as the above-mentioned relationship between the supply spool 43 and the motor Mr3, and reference numerals of corresponding members are assigned inside the bracket in FIG. 12 to omit descriptions thereof.

Described next is control and electric system of the printing apparatus 1. As shown in FIG. 13, the printing apparatus 1 has a controller 100 that performs operation control of the entire printing apparatus 1, and a power supply section 120 that transforms utility AC power supply into DC power supply that enables each mechanism section, controller and the like to be driven and actuated.

<Controller>

As shown in FIG. 13, the controller 100 is provided with a microcomputer 102 that performs entire control processing of the printing apparatus 1. The microcomputer 102 is comprised of a CPU that operates at fast clock as the central processing unit, ROM in which are stored programs of the printing apparatus 1 and program data related to the reference motor described later and the like, RAM that works as a work area of the CPU, and internal buses that connect the components.

The microcomputer 102 is connected to an external bus. The external bus is connected to an interface, not shown, to communicate with the higher apparatus 201, and buffer memory 101 to temporarily store printing data to print on the card Ca, recording data to magnetically or electrically record in a magnetic stripe or stored IC of the card Ca, and the like.

Further, the external bus is connected to a sensor control section 103 that controls signals from various sensors, an actuator control section 104 including motor drivers and the like for supplying drive pulses and drive power to respective motors, a thermal head control section 105 to control thermal energy to heating elements constituting the thermal head 40, an operation display control section 106 to control the operation panel section 5, a nonvolatile memory 107 such as EEPROM and flash memory, and the above-mentioned information recording section A.

Herein, a motor driver (not shown) which constitutes a part of the actuator control section 104 and supplies drive power to the motors Mr1 and Mr3 will be described briefly. In this Embodiment, the motor driver is configured by having a timer IC that generates a pulse train to enable duty (supply current) to be changed. Such duty is given as data from the microcomputer 102 side. In addition, in assuming that a period of a switching frequency is T and that current passage time is t, the duty is expressed by $\{(T-t/T)\}\times100(\%)$. Therefore, the motors Mr1 and Mr3 are driven by PWM (Pulse Width Modulation) pulses generated in the timer IC according to the duty indicated by the CPU of the microcomputer 102. In addition, in order to suppress noise while enhancing energy efficiency, flywheel diodes (not shown) are parallel connected to the motors Mr1 and Mr3, respectively.

The power supply section 120 supplies operation/drive power to the controller 100, thermal head 40, heat roller 33, operation panel section 5, information recording section A and the like.

<Operation>

Next, referring to a flowchart, card issue operation by the printing apparatus 1 according to this Embodiment will be described with particular emphasis on the CPU (hereinafter, simply referred to as CPU) of the microcomputer 102. In addition, the description will be given while assuming that each of members constituting the printing apparatus 1 is positioned in a home (initial) position (for example, state as shown in FIG. 2), and that initial setting processing for expanding programs and program data stored in the ROM in the RAM is already finished. Further, the operation of the printing section B (image formation section B1, transfer section B2) is already described, and therefore, in order to omit redundancy, the description will be given simply.

Figure 14:
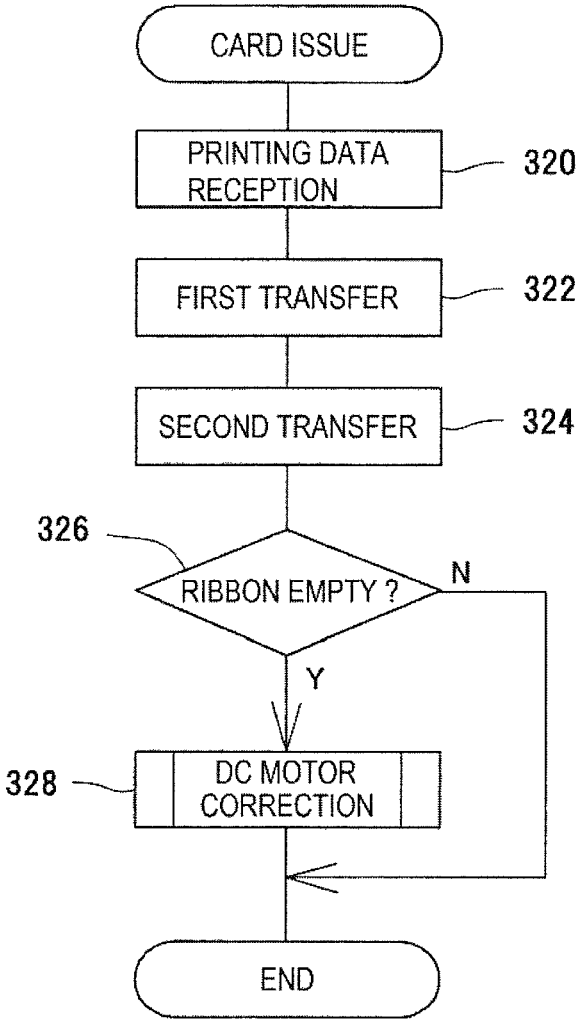
FIG. 14 is a flowchart of a card issue routine executed by a CPU of a microcomputer of the controller in the printing apparatus of this Embodiment.

As shown in FIG. 14, in a card issue routine, in step 320, printing data and the like is received from the higher apparatus 201. In other words, the CPU receives the printing data (printing data of Bk, color component printing data of Y, M, C) for one surface (for example, frontside) and the other surface (for example, backside) and the magnetic or electric recording data from the higher apparatus 201 to store in the buffer memory 101.

In next step 322, the CPU performs first transfer processing to form an image (mirror image) on the transfer film 46 in the image formation section B1. In other words, by controlling the thermal head 40 of the image formation section B1 according to the color component printing data of Y, M, C and printing data of Bk stored in the buffer memory 101, the section B1 forms an image with Y, M, C and Bk ink of the ink ribbon 41 on the transfer film 46. The CPU outputs the printing data for each line to the thermal head 40 side via the thermal head control section 105, and thereby selectively heats the heating elements lined in the main scanning direction to drive the thermal head 40. In addition, in this Embodiment, after forming the image of the one surface side in the region of the transfer film 46, an image of the other surface side is formed in the next region of the transfer film 46.

In parallel with the first transfer processing in step 322, the CPU feeds the card Ca out of the media storage section C, performs recording processing on the card Ca based on the magnetic or electric recording data, in one of the magnetic recording section 24, non-contact type IC recording section 23 and contact type IC recording section 27 constituting the information recording section A, and then, transports the card Ca to the transfer section B2.

In next step 324, the CPU performs second transfer processing to transfer the image formed on the transfer film 46 to the card Ca in the transfer section B2. In the second transfer processing, the CPU controls so that the card Ca and the image formed in the region of the transfer film 46 arrive at the transfer section B2 in synchronization with each other. In addition after transferring the image to one surface of the card Ca, the CPU transports the card Ca to the rotating unit F side to rotate the card Ca 180°, and transfers the image for the other surface to the other surface of the card Ca.

Next, in step 326, the CPU determines whether or not the sensor Se2 detects the empty mark attached to the end portion of the ink ribbon 41, and in a negative determination, finishes the card issue routine. In a positive determination, the CPU executes DC motor correction processing in next step 328, and finishes the card issue routine. In addition, in parallel with steps 326 and 328, the CPU corrects curl of the card Ca occurring by thermal transfer by the heat roller 33 with the decurl mechanism 36, and then, discharges the card Ca toward the storage stocker 60.

(DC Motor Correction)

Figure 15:
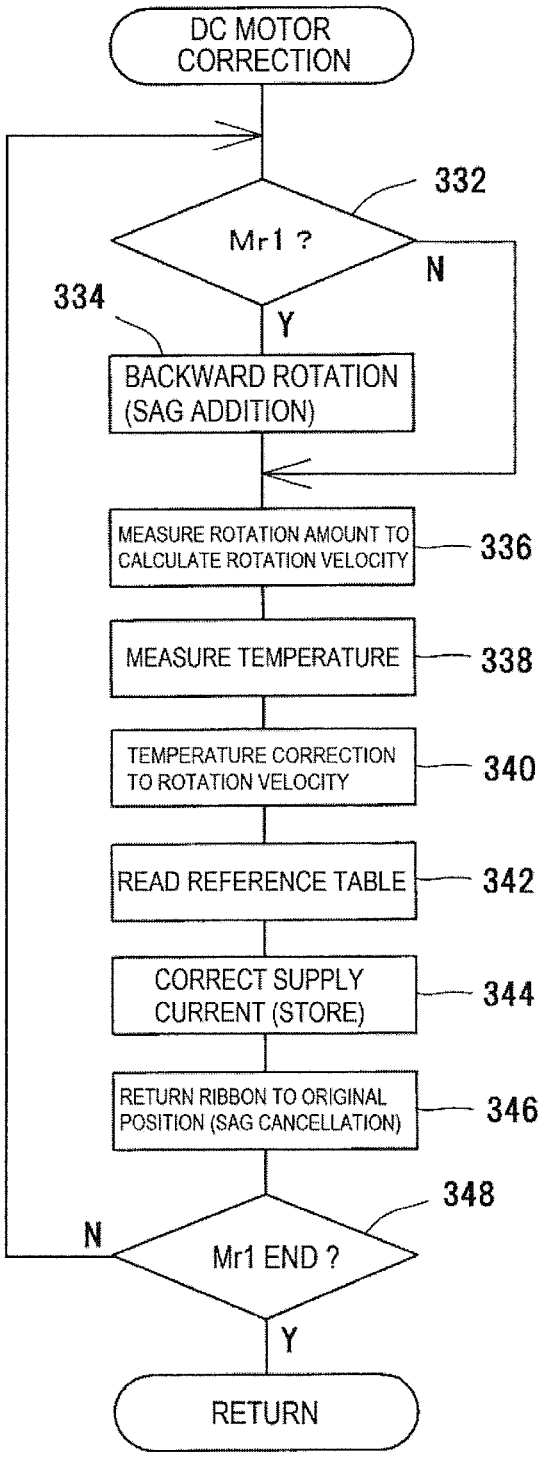
FIG. 15 is a flowchart of a of a DC motor correction subroutine illustrating details of DC motor correction processing of the card issue routine.

Details of the DC motor correction processing in step 328 in FIG. 14 will be described next with reference to FIG. 15, and further, before the details, the overview of the DC motor correction processing will be described.

Figure 17A:
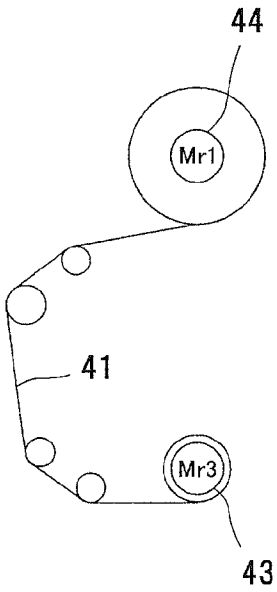
FIGS. 17A to 17E contain explanatory views schematically illustrating a procedure for respectively measuring rotation velocities of DC motors for rotating a supply spool and a wind-up spool in this Embodiment, where
Figure 17B:
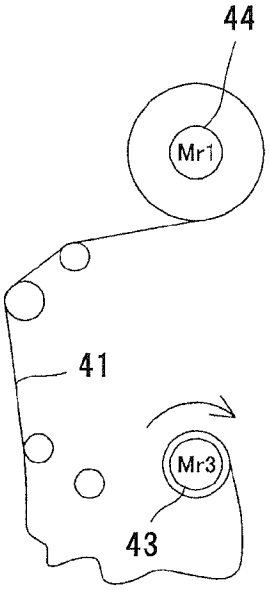

As shown in FIGS. 17A to 17E, after the sensor Se2 detects the empty mark attached to the end portion of the ink ribbon 41 (see FIG. 17A), the CPU drives the motor Mr3 to rotate forward while halting the motor Mr1 so as to sag the ink ribbon 41 (see FIG. 17B). For the motors Mr1 and Mr3, the forward rotation is set for the rotation direction (i.e. rotation direction for the direction in which the ink ribbon 41 is transported in the printing processing) in transporting the ink ribbon 41 from the supply spool 43 side to the wind-up spool 44 side, and the backward rotation is set for the opposite direction. The reason for making such setting is that the DC motor generates a difference in the rotation velocity by the rotation direction. When the motor Mr3 rotates forward, the rotation is the same direction as in image formation operation in the image formation section B1, and therefore, the CPU retrieves a rotation amount of the Mr3 detected in the encoder 15.

Figure 17C:
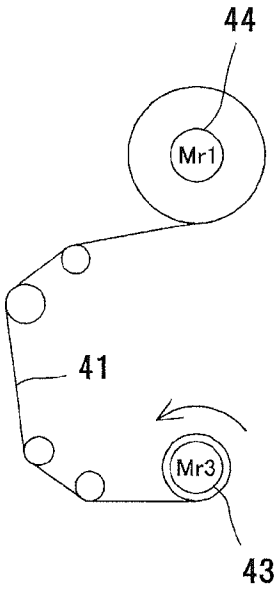
Figure 17D:
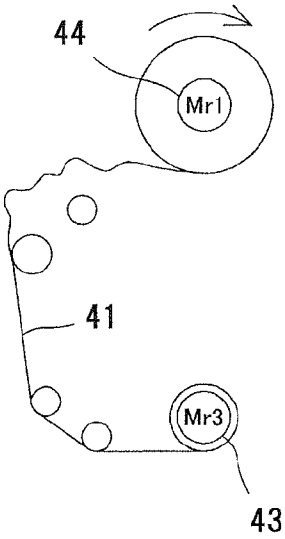

Next, to cancel the sag of the ink ribbon 41, the CPU drives the motor Mr3 to rotate backward while halting the motor Mr1 (see FIG. 17C), and then, to sag the ink ribbon 41, drives the motor Mr1 to rotate backward while halting the motor Mr3 (see FIG. 17D). When the motor Mr1 rotates backward, since the direction is opposite to the direction in image formation operation in the image formation section B1, the CPU does not retrieve the rotation amount of the motor Mr1 detected in the encoder 16 (see FIG. 12). Then, the CPU drives the motor Mr1 to rotate forward while halting the motor Mr3 (see FIG. 17E). When the motor Mr1 rotates forward, since the direction is the same as in image formation operation in the image formation section B1, the CPU retrieves the rotation amount of the motor Mr1 detected in the encoder 16.

Figure 17E:
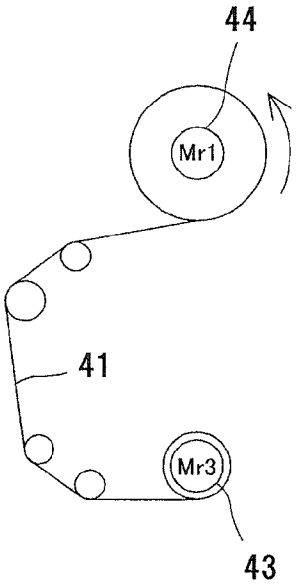
Figure 18A:
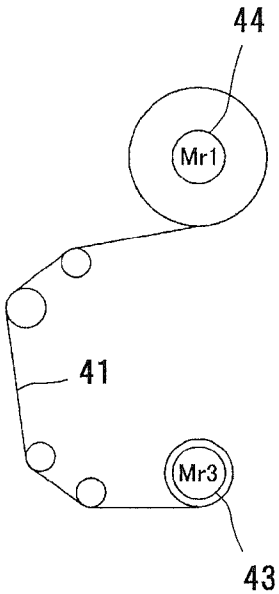
FIGS. 18A to 18E contain explanatory views schematically illustrating a procedure for respectively measuring rotation velocities of DC motors for rotating the supply spool and the wind-up spool in another Embodiment, where
Figure 18B:
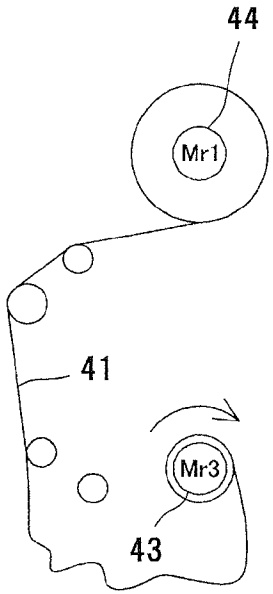
Figure 18C:
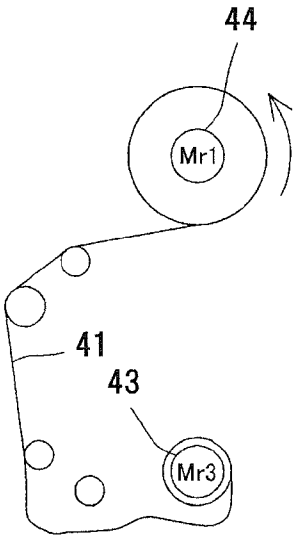
Figure 18D:
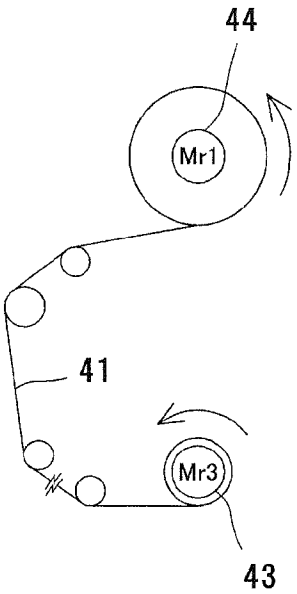
Figure 18E:
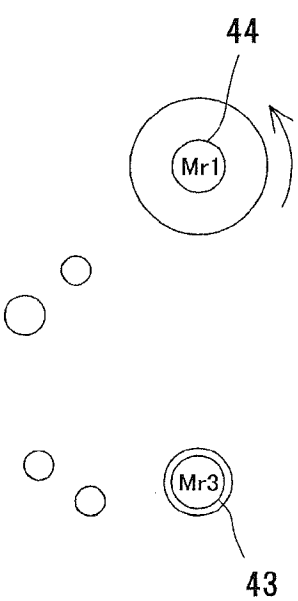

In addition, the state of FIG. 17B may shift to the state of FIG. 17E by skipping states of FIGS. 17C and 17D, but there is the risk that an error occurs in detecting the rotation amount of the motor Mr1 by a slide load and winding fluctuations of the ink ribbon 41, and therefore, in this Embodiment, the rotation amount of the motor Mr1 is detected in FIG. 17E via FIGS. 17C and 17D.

Using the above-mentioned description as a premise, details of the DC motor correction processing will be described. As shown in FIG. 15, in a DC motor correction processing subroutine, in step 332, the CPU determines whether or not a measurement target for the rotation amount is Mr1. In the example of FIGS. 17A to 17E as described above, since the rotation amount of the motor Mr3 is first measured before the motor Mr1 (see FIG. 17B), the determination in step 332 is negative, and the motor Mr3 is the measurement target.

Figure 19:
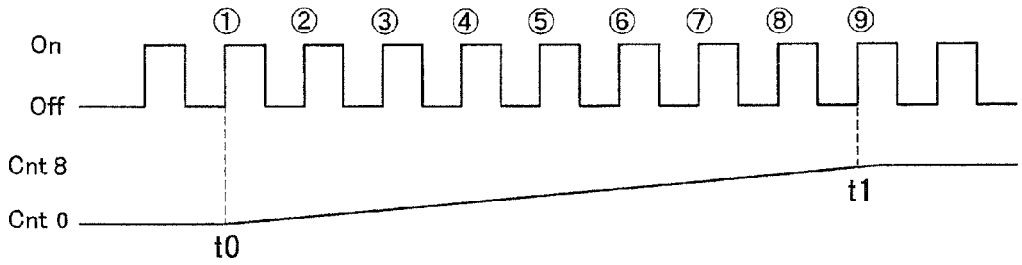
FIG. 19 is an explanatory view schematically illustrating the relationship between output and time of an encoder.

Next in step 336, the CPU measures the rotation amount of the motor Mr3 to calculate the rotation velocity. In other words, in this Embodiment, as shown in FIG. 12, eight slits are formed in the rotating plate 11, and as shown in FIG. 19, the CPU counts eight (ON, OFF) signals output from the encoder 15 when the rotating plate 11 rotates once, and measures the rotation amount of the motor Mr3 from the time (the time the rotating plate 11 rotates corresponding to eight clocks) corresponding to the count. In other words, the CPU calculates the rotation velocity of the motor Mr3 from the time (time from of time t0 to time t1) corresponding to the time taken for the encoder 15 to detect that the motor Mr3 rotates once. Since rotation of the motors Mr1 and Mr3 initially receives the effect by the inertia of the ink ribbon 41 wound around the spools, as shown in FIG. 19, output from the encoder 15 in initial rotation is not referred (discarded). In addition, this Embodiment uses the CPU having the timer function of a period of 1 ms.

In next step 338, the ambient temperature of the motor Mr3 is measured with the temperature sensor Th, and in next step 340, the CPU applies the rotation velocity of the motor Mr3 calculated in step 336 to a beforehand determined relationship table or relationship equation between the rotation velocity and the temperature to make a temperature correction to the rotation velocity at a predetermined temperature (for example, 25° C.).

Figure 20:
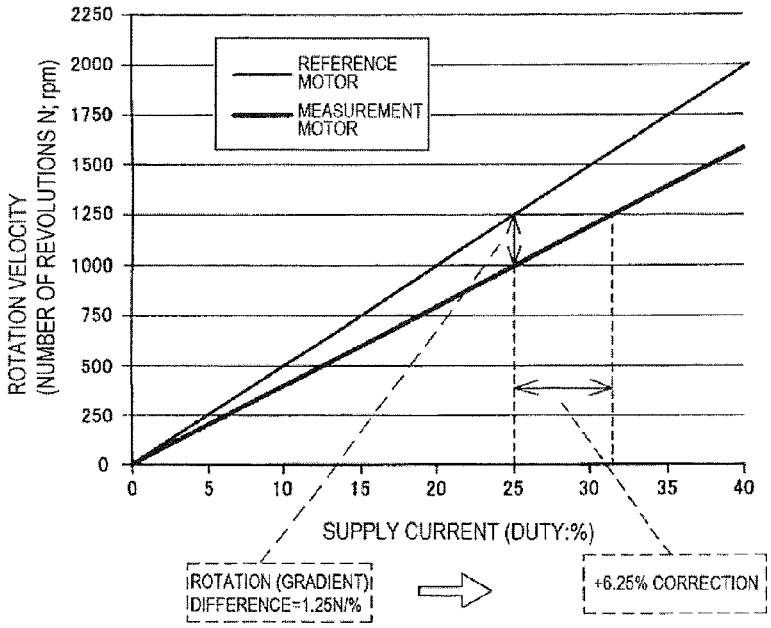
FIG. 20 is an explanatory view illustrating the relationship between the number of revolutions and the supply current of each of a measurement motor and a reference motor.

Next, in step 342, the CPU reads a reference table, and in step 344, the CPU corrects a supply current to the motor Mr3. In other words, in step 342, as shown in FIG. 20, the CPU reads a relationship table or relationship equation indicative of the beforehand determined relationship between the rotation velocity and the supply current in the reference motor. Further, in step 344, the CPU applies the rotation velocity of the motor Mr3 subjected to temperature correction in step 340 and the supply current in driving the motor Mr3 to the relationship table or relationship equation, calculates a supply current of the motor Mr3 for providing the same rotation velocity as the rotation velocity in driving the reference motor with the supply current with which the motor Mr3 is driven, and stores the calculated value of the supply current of the motor Mr3 in the nonvolatile memory 107 (see FIG. 13). The reason why the calculation result is stored in the nonvolatile memory 107 is that the CPU displays a message of need of replacement of the ink ribbon cassette 42 in the operation panel section 5 in detecting the empty mark, and that the operator may thereby turn off a power supply of the printing apparatus 1 in replacing with a new ink ribbon cassette.

FIG. 20 shows the case where the rotation velocity (the number of revolutions N) of the motor Mr3 is 1000 rpm, for example, the duty at this time is 25%, and the rotation velocity of the reference motor relative to this duty is 1250 rpm, and shows the example that the CPU calculates rotation (gradient)

difference=(1250÷1000)=1.25, calculates the supply current (duty) as supply current=25%×1.25-31.25% to make the same rotation velocity (1250 rpm) as that of the reference motor, and increases by 6.25% (32.25%-25%).

Next in step 346, as shown in FIG. 17C, the CPU drives the motor Mr3 to rotate backward to return the sagged ink ribbon 41 to the original position (remove the sag), and in next step 348, determines whether or not the DC motor correction processing on the motor Mr1 is finished. In the above-mentioned example, since the processing on the motor Mr1 is not finished, the CPU returns to step 332.

The determination in step 332 is positive. In next step 334, as shown in FIG. 17D, the CPU drives the motor Mr1 to rotate backward to provide the ink ribbon 41 with the sag. Then, as in the case of the motor Mr3, in steps 336 to 344, the CPU calculates a supply current of the motor Mr1 for providing the same rotation velocity as the rotation velocity in driving the reference motor with the supply current with which the motor Mr1 is driven forward, and stores the calculated value of the supply current of the motor Mr1 in the nonvolatile memory 107. Then, in step 346, as shown in FIG. 17E, subsequently the CPU drives the motor Mr1 to rotate further forward to return the sagged ink ribbon 41 to the original position (remove the sag), and via a determination in step 348 (logically made a positive determination), finishes the DC motor correction subroutine.

In addition, the printing apparatus 1 has a transmission sensor to detect attachment and detachment of the ink ribbon cassette 42, and by monitoring output of the transmission sensor, when the ink ribbon cassette 42 is replaced with a new ink ribbon cassette or in the above-mentioned initial setting processing, the CPU drives the motors Mr1 and Mr3 with the corrected supply current by adding the value of the supply current stored in the nonvolatile memory 107 to the above-mentioned timer IC as data.

<Effects and Others>

The effects and others of the printing apparatus 1 of this Embodiment will be described next.

In the printing apparatus 1 of this Embodiment, in a state in which the ink ribbon 41 is sagged i.e. in a state in which the tension of the ink ribbon 41 is not applied to the motors Mr1 and Mr3, the motors Mr1 and Mr3 are driven forward (FIGS. 17B and 17E) to calculate the rotation velocities of the motors Mr1 and Mr3, and it is thereby possible to properly correct supply currents of the motors Mr1 and Mr3. Therefore, according to the printing apparatus 1 of this Embodiment, even when the motors Mr1 and Mr3 undergo age deterioration, it is possible to prevent the image quality from deteriorating.

Further, in the printing apparatus 1 of this Embodiment, in driving the motors Mr1 and Mr3 without the tension due to the ink ribbon 41 being applied, the rotation velocity is measured by driving (forward rotation) in the same direction as the rotation direction of the motors Mr1 and Mr3 in transporting the ink ribbon 41 from the supply spool side 43 to the wind-up spool 44 side. Accordingly, in the DC motor with a difference in the rotation velocity between forward-rotation driving and backward-rotation driving, the corrections of the motor Mn and Mr3 are made in the rotation direction for actually transporting the ink ribbon 41, and it is thereby possible to correct the supply currents to the motors Mr1 and Mr3 with accuracy.

Further, in the printing apparatus 1 of this Embodiment, since the corrections of the motors Mr1 and Mr3 are made before inserting a new ink ribbon cassette 42 after detecting the empty mark attached to the old ink ribbon 41, it is possible to prevent dirt from adhering to a sagged new ink ribbon 41, and prevent winding fluctuations, which occur in rewinding the once sagged new ink ribbon 41 and are the main cause of skew in transport of the ink ribbon 41, from occurring.

Furthermore, the printing apparatus 1 of this Embodiment is provided with the temperature sensor Th, applies the calculated rotation velocity to the beforehand determined relationship between the rotation velocity and the temperature to make a temperature correction to the rotation velocity at a predetermined temperature, and is thereby capable of correcting the supply currents to the motor Mr1 and Mr3 with higher accuracy.

In addition, this Embodiment illustrates the printing apparatus 1 of indirect printing scheme, but the present invention is not limited thereto, and is applicable also to a printing apparatus of direct printing scheme as disclosed in Patent Document 1. Further, this Embodiment illustrates the ink ribbon 41 as a film-shaped transfer medium, but the invention is not limited thereto, and is applicable also to the transfer film 46. In other words, when the "film-shaped medium" of claim 1 is the ink ribbon 41, the "printing target medium" is the transfer film 46, the "printing section" is the image formation section B1, the "supply spool" is the supply spool 43, and the "wind-up spool" is the wind-up spool 44. On the other hand, when the "film-shaped medium" of claim 1 is the transfer film 46, the "printing target medium" is the card Ca, the "printing section" is the transfer section B2, the "supply spool" is the supply spool 48, and the "wind-up spool" is the wind-up spool 47. In other words, it is possible to make corrections of supply current similarly to the motors Mr2 and Mr4.

Further, this Embodiment illustrates the motor Mr3 for rotating the supply spool 43 and the motor Mr1 for rotating the wind-up spool 44, but the present invention is not limited thereto, and for example, is applicable to an aspect for driving the supply spool 43 and the wind-up spool 44 with a single DC motor via a plurality of gears. In such an aspect, in order to halt transfer of the rotation drive force to one of the spools, for example, a clutch mechanism such as an electromagnetic clutch may be used.

Furthermore, this Embodiment shows the example of calculating the rotation velocities of the motors Mr1 and Mr3 from the time corresponding to the time during which the encoders 15 and 16 detect that the motors Mr1 and Mr3 rotate a predetermined amount, respectively, (see FIG. 19), but the present invention is not limited thereto, and the rotation velocities may be calculated from the rotation amounts of the motors Mr1 and Mr3 detected by the encoders 15 and 16 for a predetermined time, respectively.

Figure 16:
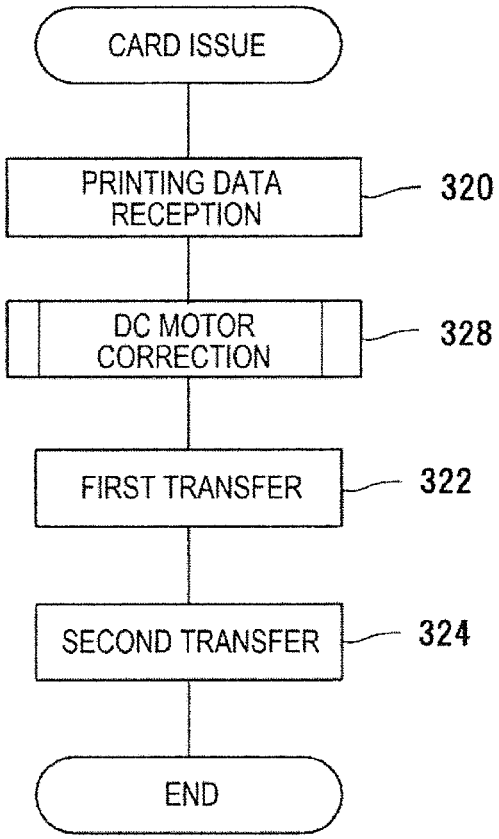
FIG. 16 is a flowchart of the card issue routine executed by the CPU of the microcomputer of the controller in the printing apparatus of another Embodiment.

Still furthermore, this Embodiment shows the example of making corrections to the motors Mr1 and Mr3 after detecting the empty mark attached to the ink ribbon 41, but the present invention is not limited thereto, and for example, as shown in FIG. 16, the DC motor correction processing (step 328) may be performed for each printing (for example, before the first transfer processing in step 322). As the advantage of such an Embodiment, as well as being able to correct the supply current with respect to age deterioration of the motors Mr1 and Mr3, since the DC motor correction processing is performed for each printing, it is possible to make a proper supply current correction corresponding to the ambient temperatures of the motors Mr1 and Mr3.

Moreover, as shown in FIGS. 17A to 17E, this Embodiment shows the example of measuring the rotation velocity in the order of the motor Mr3 and motor Mr1, but the present invention is not limited thereto, and the rotation velocity may be measured in the order of the motor Mr1 and motor Mr3. In other words, with the description given according to FIGS. 17A to 17E, the procedure may be the order of FIGS. 17A, 17D, 17E, 17B and 17C. More specifically, after the sensor Se2 detects the empty mark (FIG. 17A), the CPU drives the motor Mr1 to rotate backward while halting driving of the motor Mr3 to sag the ink ribbon 41 (FIG. 17D), drives the motor Mr1 to rotate forward while halting driving of the motor Mr3 (FIG. 17E), calculates the rotation velocity of the motor Mr1 to correct the supply current, drives the motor Mr3 to rotate forward while halting driving of the motor Mr1, calculates the rotation velocity of the motor Mr3 to correct the supply current (FIG. 17B), drives the motor Mr3 to rotate backward while halting the motor Mr1, and cancels the sag of the ink ribbon (FIG. 17C).

Further, since the empty mark attached to the ink ribbon 41 indicates a use limit of the ink ribbon 41, the ink ribbon 41 may be broken not to apply the tension of the ink ribbon 41 to the motor Mr1. In such an Embodiment, for example, a tear-off strip or a partially broken weak portion is formed on the end side closer to the end than the position in which the empty mark is attached in the ink ribbon 41. FIG. 18 shows a measurement procedure of rotation velocities of the motors Mr1 and Mr3 in such an Embodiment.

More specifically, after the sensor Se2 detects the empty mark (FIG. 18A), the CPU drives the motor Mr3 to rotate forward while halting driving of the motor Mr1 to calculate the rotation velocity of the motor Mr3 (FIG. 18B), drives the motor Mr1 to rotate forward while halting driving of the motor Mr3, winds up the ink ribbon 41 with the wind-up spool 44 (FIG. 18C), drives the motor Mr3 to rotate backward to break the ink ribbon 41 in the exposed weak portion, further winds up the broken end portion of the ink ribbon 41 with the wind-up spool 44 (FIG. 18D), drives the motor Mr1 to rotate forward while halting driving of the motor Mr3, and calculates the rotation velocity of the motor Mr1 to correct the supply current. In addition, the supply spool 43 winds up the other broken end of the ink ribbon 41 before the motor Mr3 is halted.

Further, this Embodiment shows the example of forming images for one surface and the other surface in respective different regions of the transfer film 46 (step 322), and then, respectively transferring the images for one surface and the other surface formed on the transfer film 46 to one surface and the other surface of the card Ca (step 324), but the present invention is not limited thereto. An image for one surface may be formed on the transfer film 46 to transfer the formed image for one surface to one surface of the card Ca, and then, an image for the other surface may be formed on the transfer film 46 to transfer the formed image for the other surface to transfer to the other surface of the card Ca.

Furthermore, in this Embodiment, since the apparatus has the nonvolatile memory 107, the CPU may store the cumulative rotation amount of the encoder 15 in the nonvolatile memory, and refer to a table or equation for beforehand determining the relationship between the cumulative rotation amount and the duty (supply current) to correct the supply currents to the motors Mr1 and Mr3.

In addition, this Embodiment discloses the configuration in which the transport direction in the printing processing of the ink ribbon 41 and the transfer film 46 is the direction for transporting from the supply spools 43, 48 to the wind-up spools 44, 47 side, and the printing processing may be performed while winding up the ink ribbon 41 and transfer film 46 with the supply spools. In this case, the rotation direction in detecting the rotation amount of the DC motor is the rotation direction for transporting the ink ribbon 41 and transfer film 46 from the wind-up spool side to the supply spool side. In either case, it is desirable to detect the rotation amount of the DC motor while driving in the same direction as the rotation direction of the DC motor in transporting the ink ribbon 41 and transfer film 46 in the printing processing.

Then, as a matter of course, although this Embodiment illustrates the ink ribbon cassette 42, the present invention is not limited thereto, and is applicable to an ink ribbon of the type that does not use a cassette.

[Industrial Applicability]

In addition, this application claims priority from Japanese Patent Application No. 2014-079572 incorporated herein by reference.

The invention claimed is:

1. A printing apparatus provided with a printing section to print text or an image on a printing target medium from a film-shaped medium, comprising:

a supply spool that feeds out a film-shaped medium to the printing section in printing processing;

a wind-up spool that winds up the film-shaped medium from the printing section in the printing processing;

a DC motor that rotates at least one of the supply spool and the wind-up spool;

a motor driver that supplies a drive current to the DC motor;

a rotation amount detector that detects a rotation amount of the DC motor; and a controller that controls the motor driver, wherein the controller calculates a drive current to be supplied to the DC motor for providing the DC motor with a same rotation velocity as a rotation velocity of a reference DC motor based on a difference between a rotational speed of the DC motor in driving the DC motor at a predetermined supply current without a tension due to the film-shaped medium being applied and a rotational speed of the reference DC motor in driving the reference DC motor at the predetermined supply current, and controls the motor driver to supply the calculated drive current.

2. The printing apparatus according to claim 1, wherein in driving the DC motor without the tension due to the film-shape medium being applied, the controller drives in the same direction as the rotation direction of the DC motor for transporting the film-shaped medium from the supply spool side to the wind-up spool side.

3. The printing apparatus according to claim 1, wherein before printing processing with the printing section, the controller drives the DC motor with the film-shaped medium sagged to calculate the rotation velocity.

4. The printing apparatus according to claim 1, further comprising:

a mark detector that detects an empty mark indicative of a use limit of the film-shaped medium, the empty mark being attached to an end portion of the film-shaped medium, wherein after the mark detector detects the empty mark, the controller drives the DC motor with the film-shaped medium sagged to calculate the rotation velocity.

5. The printing apparatus according to claim 4, further comprising:

a nonvolatile memory, wherein the controller stores the calculated value of supply current in the nonvolatile memory, reads the value of supply current stored in the nonvolatile memory after replacing the film-shaped medium with a new film-shaped medium, and controls the motor driver to supply the supply current with the read value of supply current.

6. The printing apparatus according to claim 1, further comprising:

a temperature detector that detects an ambient temperature of the DC motor, wherein the controller applies the calculated rotation velocity to a beforehand determined relationship between the rotation velocity and the temperature to make a temperature correction to the rotation velocity at a predetermined temperature.

7. The printing apparatus according to claim 1, wherein the DC motor is comprised of a first DC motor that rotates the supply spool, and a second DC motor that rotates the wind-up spool, and the controller calculates the rotation velocity of the first DC motor by driving the first DC motor to rotate in the same direction as a rotation direction for transporting the film-shaped medium from the supply spool side to the wind-up spool side, sags the film-shaped medium by driving the second DC motor to rotate in a direction opposite to the rotation direction for transporting the film-shaped medium from the supply spool side to the wind-up spool side, while halting driving of the first DC motor, and calculates the rotation velocity of the second DC motor by driving the second DC motor to rotate in the same direction as the rotation direction for transporting the film-shaped medium.

8. The printing apparatus according to claim 1, wherein the DC motor is comprised of a first DC motor that rotates the supply spool, and a second DC motor that rotates the wind-up spool, and the controller sags the film medium by driving the second DC motor to rotate in a direction opposite to a rotation direction for transporting the film-shaped medium from the supply spool side to the wind-up spool side, calculates the rotation velocity of the second DC motor by driving the second DC motor to rotate in the same direction as the rotation direction for transporting the film-shaped medium, and calculates the rotation velocity of the first DC motor by driving the first DC motor in the same direction as the rotation direction for transporting the film-shaped medium from the supply spool side to the wind-up spool side, while halting driving of the second DC motor.

9. The printing apparatus according to claim 1, wherein the controller drives the DC motor without the tension due to the film-shaped medium being applied, calculates a rotation velocity of the DC motor based on the rotation amount of the DC motor detected in the rotation amount detector, refers to a relationship between the rotation velocity and the supply current in the reference motor, calculates a supply current of the DC motor for providing the same rotation velocity as a rotation velocity of the time the reference motor is driven with the supply current at the calculated rotation velocity, and controls the motor driver to supply the calculated supply current.

10. The printing apparatus according to claim 1, further comprising:

a mark detector that detects an empty mark indicative of a use limit of the film-shaped medium attached to an end portion of the film-shaped medium, wherein in the film-shaped medium is formed a weak portion on the end side closer to the end than a position in which the empty mark is attached, the DC motor is comprised of a first DC motor that rotates the supply spool, and a second DC motor that rotates the wind-up spool, and after the mark detector detects the empty mark, and the controller calculates the rotation velocity of the first DC motor by driving the first DC motor to rotate in the same direction as a rotation direction for transporting the film-shaped medium from the supply spool side to the wind-up spool side, drives the second DC motor to rotate in the same direction as the rotation direction for transporting the film-shaped medium while halting driving of the first DC motor to wind up the film-shaped medium with the wind-up spool, drives the first DC motor to rotate in a direction opposite to the rotation direction for transporting the film-shaped medium to break the film-shaped medium in the weak portion, further winds up the broken weak portion of the film-shaped medium with the wind-up spool, and calculates the rotation velocity of the second DC motor by driving the second DC motor to rotate in the same direction as the rotation direction for transporting the film-shaped medium, while halting driving of the first DC motor.

* * * * *